United States Patent [19]

GangaRao

[11] 4,320,606

[45] Mar. 23, 1982

[54] REINFORCED CONCRETE PANELS AND BUILDING CONSTRUCTED THEREWITH

[75] Inventor: Hota V. S. GangaRao, Morgantown, W. Va.

[73] Assignee: Home Crafts Corporation, Clarksburg, W. Va.

[21] Appl. No.: 100,815

[22] Filed: Dec. 6, 1979

[51] Int. Cl.[3] ..... E04C 2/04

[52] U.S. Cl. ..... 52/125; 52/583; 52/600; 52/612

[58] Field of Search ..... 52/125, 612, 600, 583, 52/581, 405

[56] References Cited

U.S. PATENT DOCUMENTS

| | | | |
|---|---|---|---|
| 2,095,642 | 10/1937 | Knight | 52/314 |
| 2,462,415 | 2/1949 | Nagel | 72/107 |
| 2,592,634 | 4/1952 | Wilson | 52/583 |
| 3,236,019 | 2/1966 | Ballon | 52/125 |
| 3,305,991 | 2/1967 | Weismann | 52/612 |
| 3,435,567 | 4/1969 | Tyson | 52/125 |
| 3,555,763 | 1/1971 | Bloxom | 52/745 |
| 3,747,287 | 7/1973 | Finger | 52/18 |
| 3,760,540 | 9/1973 | Latoria | 52/125 |
| 4,006,570 | 2/1977 | Stolz | 52/587 |
| 4,069,629 | 1/1978 | Piazza | 52/125 |
| 4,069,809 | 1/1978 | Strand | 52/612 |

FOREIGN PATENT DOCUMENTS

| | | | |
|---|---|---|---|
| 708726 | 8/1931 | France | 52/583 |
| 684249 | 3/1965 | Italy | 52/125 |

*Primary Examiner*—Price C. Faw, Jr.
*Assistant Examiner*—Henry E. Raduazo
*Attorney, Agent, or Firm*—Cushman, Darby & Cushman

[57] ABSTRACT

A building formed by assembling a multiplicity of precast reinforced concrete panels including horizontal footer panels, solid exterior vertical panels, exterior vertical corner panels, exterior vertical door panels, exterior vertical window panels, interior solid vertical panels, interior vertical door panels, interior vertical partition panels, horizontal floor/ceiling panels, and horizontal ceiling/roof panels, the various panels being joined together in side-by-side relation by continuous welds of welding bars rigidly mounted to the reinforcing of the panels, the vertical panels being connected with the horizontal panels by connecting rod assemblies, the panels providing built-in electrical junction boxes and access wiring thereto, plumbing passageways and temperature air ducts.

20 Claims, 18 Drawing Figures

200
184
206
26
202
186
196
184
186
182
198
182
180
194
190
188
186
192
184
186
184
208
204

214
224
214
216
216
30
220
220
212
212
214
216
216
214
222
226

REINFORCED CONCRETE PANELS AND BUILDING CONSTRUCTED THEREWITH

This invention relates to building construction and more particularly to the construction and formation of buildings from a series of interconnected reinforced concrete panels.

There have been many proposals over the years to construct buildings with a series of interconnected reinforced concrete panels. Examples of the prior art of this type included in the patented literature are as follows: U.S. Pat. Nos. 2,462,415; 3,555,763; and 3,747,287.

The type of construction herein contemplated is relatively small structures, such as single family dwellings, three story apartment complexes, two or three story industrial buildings and the like. Principally the type of building contemplated is the type which is presently constructed with wood framing utilizing various finishes, either ceramic or wood, on the exterior and interior thereof. The invention would have limited applicability to high-rise apartments and multistory office buildings of the type which is currently constructed of reinforced concrete poured on site.

Buildings constructed of reinforced concrete have two basic advantages over conventional buildings constructed of wood. First, concrete structures are much more fire-proof than wooden structures. Second, a concrete structure can be expected to last longer than a wooden structure. While these two advantages are real and recognizable, they are not the kind of advantages which greatly enhance the value of the structure. That is, prospective purchasers normally are not willing to pay a greater price to purchase a building which will last beyond the purchaser's lifetime, and the incidence of fires in wooden dwellings is sufficiently rare that here again, prospective purchasers are not willing to pay a premium price for the safety which is provided by a concrete structure, since the chances of any given wooden structure burning may be regarded as relatively low. In order to secure these advantages on a widescale basis, concrete structures must be sufficiently economical as to be equal to or less than the cost of a comparable wooden building.

It is an object of the present invention to achieve this result in a building of the type described utilizing a series of reinforced concrete panels. In accordance with the principles of the present invention this objective is obtained by providing panels which can be assembled into a finished building structure with a minimum of labor cost. It is generally recognized that the greatest cost factor involved in the construction of a building utilizing wood framing is the labor cost. Wood framing with exterior bricks, or wood shingles and interior plasterboard, have a material cost which is inherently less than the cost of steel reinforced concrete. By providing panels of reinforced concrete of a size which can be conveniently factory cast, transported to the site and erected with portable cranes, sufficient cost reduction in terms of the labor involved in constructing a building of such panels can be achieved if such panels have the following criteria. First, they must form the exterior and interior wall configuration without the need to provide additional finishing beyond a cosmetic coat of paint or the utilization of a particular wallpaper covering. Second, the panels which are to be utilized as exterior walls not only must provide exterior and interior surface configurations but they must likewise provide for a desirable insulation. Third, the panels must be provided with means which will enable them to be simply handled and erected. Fourth, the panels must be provided with means for effecting a secure joint between adjacent panels once erection has been achieved. Fifth, the panels must be provided with means which will facilitate the securement of utility services, such as plumbing, electricity, heating and air conditioning, etc., once installation has been achieved.

The present invention provides panel structures which will meet these criteria. The present invention contemplates a building structure made entirely of prefabricated reinforced concrete panels. The panels can be classified in two basic categories, namely, horizontal panels and vertical panels. Horizontal panels include footer panels, floor panels, floor/ceiling panels and ceiling/roof panels. The vertical panels are classified into two basic categories, one, exterior panels, and two, interior panels. The exterior panels include solid panels, corner panels, door panels and window panels. Interior panels include load bearing panels, load bearing door panels and partition panels. A further type of interior panel is a plumbing wall panel.

With respect to the footer panels, it is within the contemplation of the present invention to utilize conventional on-site poured footings rather than footer panels. The footer panels of the present invention, however, are preferred and each is of generally rectangular configuration having intersecting end-to-end and side-to-side grooves on the upper surface thereof for receiving the lower end portion of panels thereon. Footer panels are further provided with means to lift and erect the same which preferably consists of threaded sockets rigidly secured to the reinforcing grid or cage within the panel suitable to threadedly receive an outwardly extending lifting member or device which may subsequently be removed or left within the footer panel.

Likewise, it is within the contemplation of the present invention to utilize poured on-site slabs as ground floors although horizontal slabs embodying the principles of the present invention may be utilized. It is preferable to utilize panels which form both the floor and ceiling of a building as, for example, the panels which define the basement ceiling and first story floor in a one story dwelling having a basement. In accordance with the principles of the present invention, the reinforcing in such panel includes spaced reinforcing grids rigidly interconnected along the periphery thereof by reinforcing rods, each panel being formed with a void or air space in the central portion thereof.

In order to achieve an effective horizontal panel to horizontal panel securement, floor/ceiling horizontal panels are provided with welding bars along their side edges which are fixed to the reinforcing cages and recessed from the adjacent upper horizontal surface. It is within the contemplation of the present invention to replace the welding bar along one side edge of a horizontal panel, extend the same and form it with a textured surface which defines a portion of the exterior wall configuration of the building. Horizontal panels may have both ends closed, in which case the end surfaces are textured to provide a portion of the exterior of the building or alternatively, an interior end may be open with the other end being an exterior textured closed end. The central opening provides advantages in terms of a sound barrier, a conduit for temperature conditioned air and a space for plumbing pipes and electrical conduit, if necessary.

The present invention contemplates the utilization of a conventional pitched roof construction such as is provided with trusses or the like. Normally a concrete panel is not justified merely to serve as a ceiling. However, where the roof of the building can be flat, reinforced concrete panels can be used to good advantage and in this regard a similar cage reinforcing configuration with side welding bars is utilized in which the interior space is filled with insulation as, for example, polyurethane foam.

Exterior vertical panels constructed in accordance with the principles of the present invention provide exterior textured wall surfaces suitable for painting if desired, smooth interior wall surfaces also suitable for painting or wallpaper if desired, spaced reinforcing grids interconnected rigidly along their periphery with reinforcing rods and a pad or layer of insulating material such as polyurethane foam within the central portion of the panel between the grids. Corner panels provide a pair of elongated welding bars along one edge recessed from the exterior and interior surfaces thereof and a pair of parallel welding bars adjacent the other end edge in the interior surface, the other end edge being textured to provide an exterior surface. Exterior solid panels, door panels and window panels include parallel recessed welding bars at opposite side edges. The exterior panels also include a junction box extending to the interior surface at a plug terminal height and a horizontal through opening to the box. Preferably a vertical opening through each box is provided as well as a second terminal box at the lower interior surface edge of the panel. A door panel is provided with an additional junction box at a switch terminal level.

A significant feature of the present invention is the structure provided in the panels for effecting a connection between horizontal and vertical panels which preferably serve the dual function of providing a means by which the vertical panels may be lifted for handling and erection. Specifically, the vertical panels have interiorly threaded sockets rigidly attached to the reinforcing cage which are open at least to the upper end edge of the panel. Such interiorly threaded sockets are capable of threadedly receiving therein lifting hooks or swivel eyes. This enables the vertical panels to be carried by the crane in a manner suspended from above. This manner of effecting the connection between the lifting crane and the panel leaves the bottom and side edges free and the exterior and interior surfaces devoid of openings that must be subsequently grouted over. The arrangement is such that once the panel has been installed the lifting hooks or swivel eyes can be removed, leaving an open socket which is capable of being aligned with openings extending through the horizontal panel. These aligned openings can then be grouted and a connection is effected by fixing pins in the sockets in the lower end edge of a vertical panel which extend through the openings and into the grouting. In this way the two vertical panels are tied together through the intervening horizontal panel.

Another object of the present invention is the provision of a panel of the type described which is simple in construction, economical to manufacture and install and effective in operation.

These and other objects of the present invention will become more apparent during the course of the following detailed description and appended claims.

The invention may best be understood with reference to the accompanying drawings, wherein an illustrative embodiment is shown.

Figure 1:
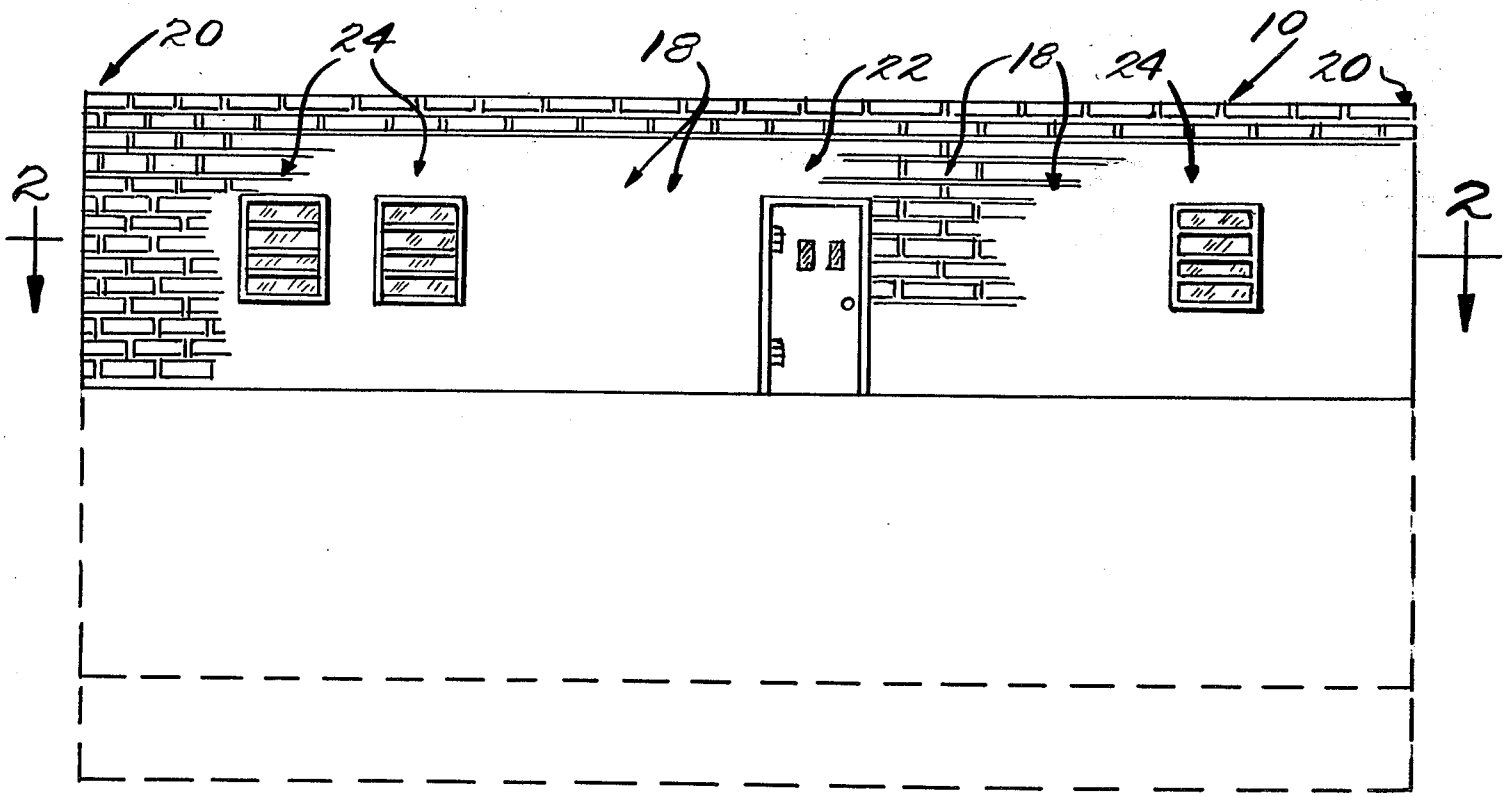
FIG. 1 is a front elevational view of a building constructed in accordance with the principles of the present invention.
Figure 2:
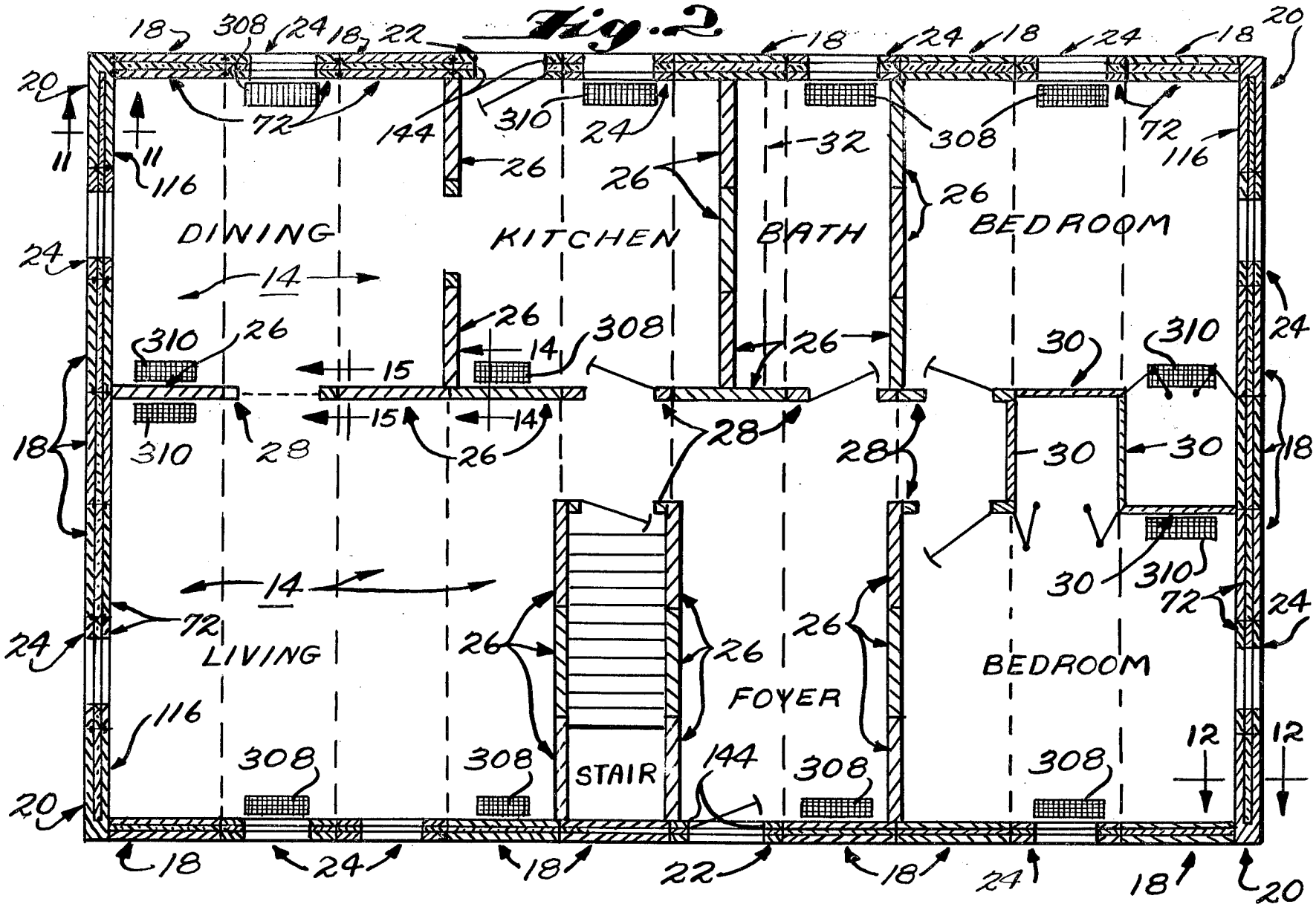
FIG. 2 is an enlarged sectional view taken along the line 2—2 of FIG. 1.

Referring now more particularly to the drawings, there is shown in FIGS. 1 and 2 an illustrative embodiment of a building, generally indicated at 10, which embodies the principles of the present invention. The building 10, as shown, constitutes a one story family dwelling with a basement. It will be understood that the building 10 is illustrative only and that the present invention has applicability to other types of buildings such as apartment houses, industrial and commercial installations, one story dwellings without a basement, and three story dwellings with or without a basement, and the like.

In accordance with the principles of the present invention, the building 10 is constructed of a series of reinforced concrete panels. The panels utilized fall generally into two major categories, one, horizontal panels; and two, vertical panels. The horizontal panels include footer panels, generally indicated at 12; floor/ceiling panels, generally indicated at 14; and ceiling/roof panels, generally indicated at 16. The vertical panels include basically two categories, one, exterior panels; and two, interior panels. The exterior panels include solid vertical panels, generally indicated at 18; corner vertical panels, generally indicated at 20; door panels, generally indicated at 22; and window panels, generally indicated at 24. The interior vertical panels include load bearing solid panels, generally indicated at 26; and load bearing door panels, generally indicated at 28. Partition panels, generally indicated at 30 and plumbing panels, generally indicated at 32, are also included within the interior vertical panel category.

It will be understood that the various panels identified above are utilized within the building 10 to provide a section of the building which corresponds in position and function to the name by which it is identified. Thus, the foundation of the building is made up of footer panels 12; the basement walls, if underground, would be made up of solid vertical panels 18 and corner vertical panels 20. The floor of the basement preferably would be provided by pouring a concrete slab on site, although it is within the contemplation of the present invention to utilize panels similar to the floor/ceiling panels 14 for this purpose. The floor/ceiling panels 14 are utilized to provide the ceiling of the basement and the floor of the first story of the building 10.

The exterior vertical walls of the first story are provided by solid vertical panels 18, corner vertical panels 20, door panels 22 and window panels 24. The interior vertical walls of the building 10 are provided by load bearing solid panels 26, load bearing door panels 28, partition panels 30 and plumbing panels 32. The building 10, as shown, is provided with a flat roof in which case the roof is formed by ceiling/roof panels 16 which define the ceiling of the first story of the building and the exterior roof of the building. The present invention contemplates the utilization of a conventional pitched roof/ceiling construction in lieu of the utilization of the ceiling/roof panels 16.

Figure 3:
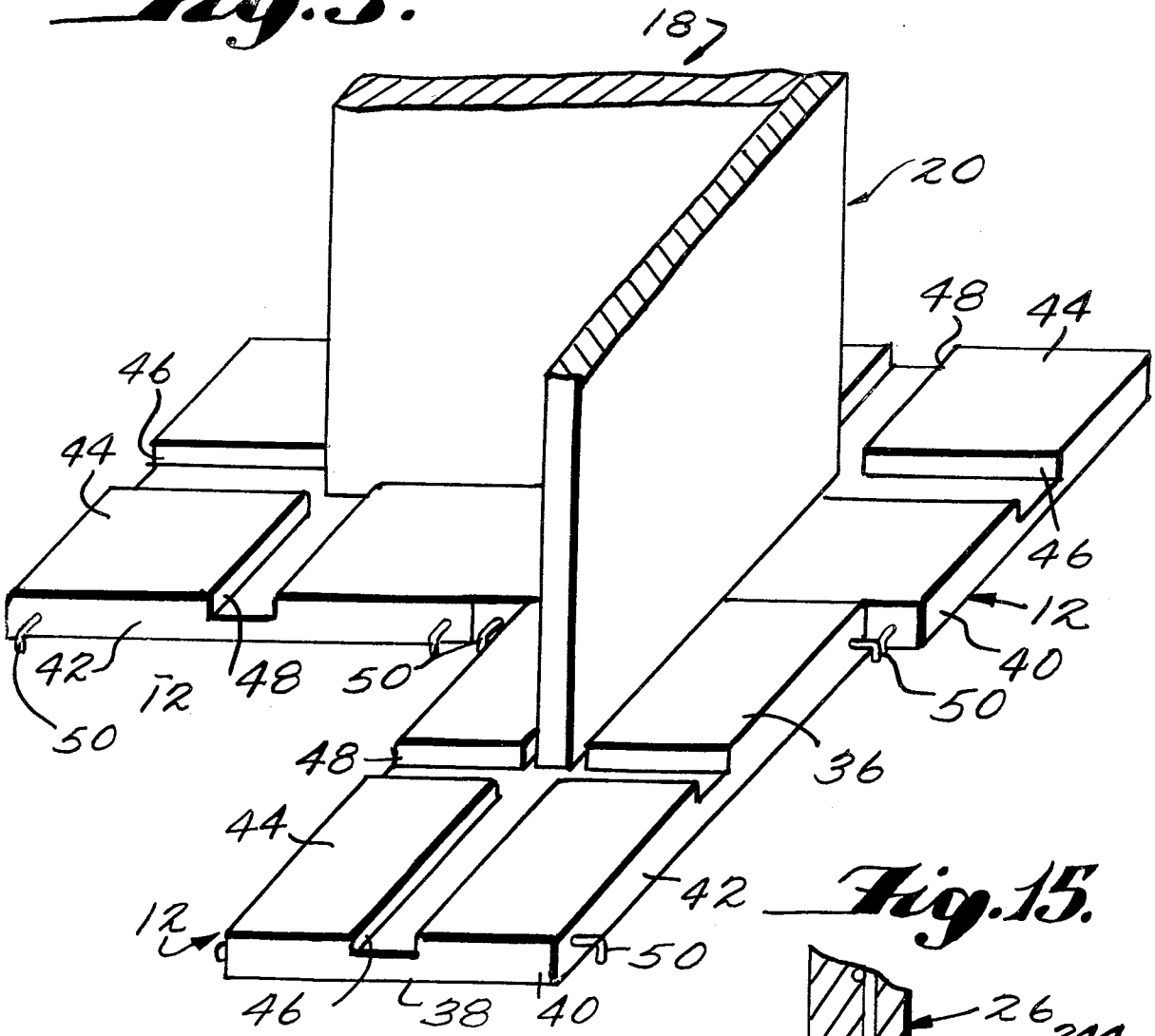
FIG. 3 is a fragmentary perspective view illustrating the construction of the footer panels and the connection thereof with the adjoining vertical panels.

Referring now more particularly to FIG. 3 of the drawings, there is shown therein a plurality of footer panels 12. Each of the footer panels 12 is formed of a horizontal reinforcing rod grid 34 having a body 36 of concrete hardened in surrounding relation to the grid so as to provide a panel having a lower surface 38, end edge surfaces 40, side edge surfaces 42 and an upper surface 44. Formed in the upper surface 44 is a central longitudinal groove 46 which extends throughout the longitudinal extent of the concrete body 36. A central transverse groove 48 is provided in the upper surface 44 which intersects with the groove 46 and extends throughout the transverse extent of the concrete body. Preferably, end rods of the grid extend outwardly from the body 36 and, after hardening of the concrete body 36, are bent downwardly as indicated at 50, to provide a means by which each footing panel 12 can be handled by a crane or the like.

Figure 4:
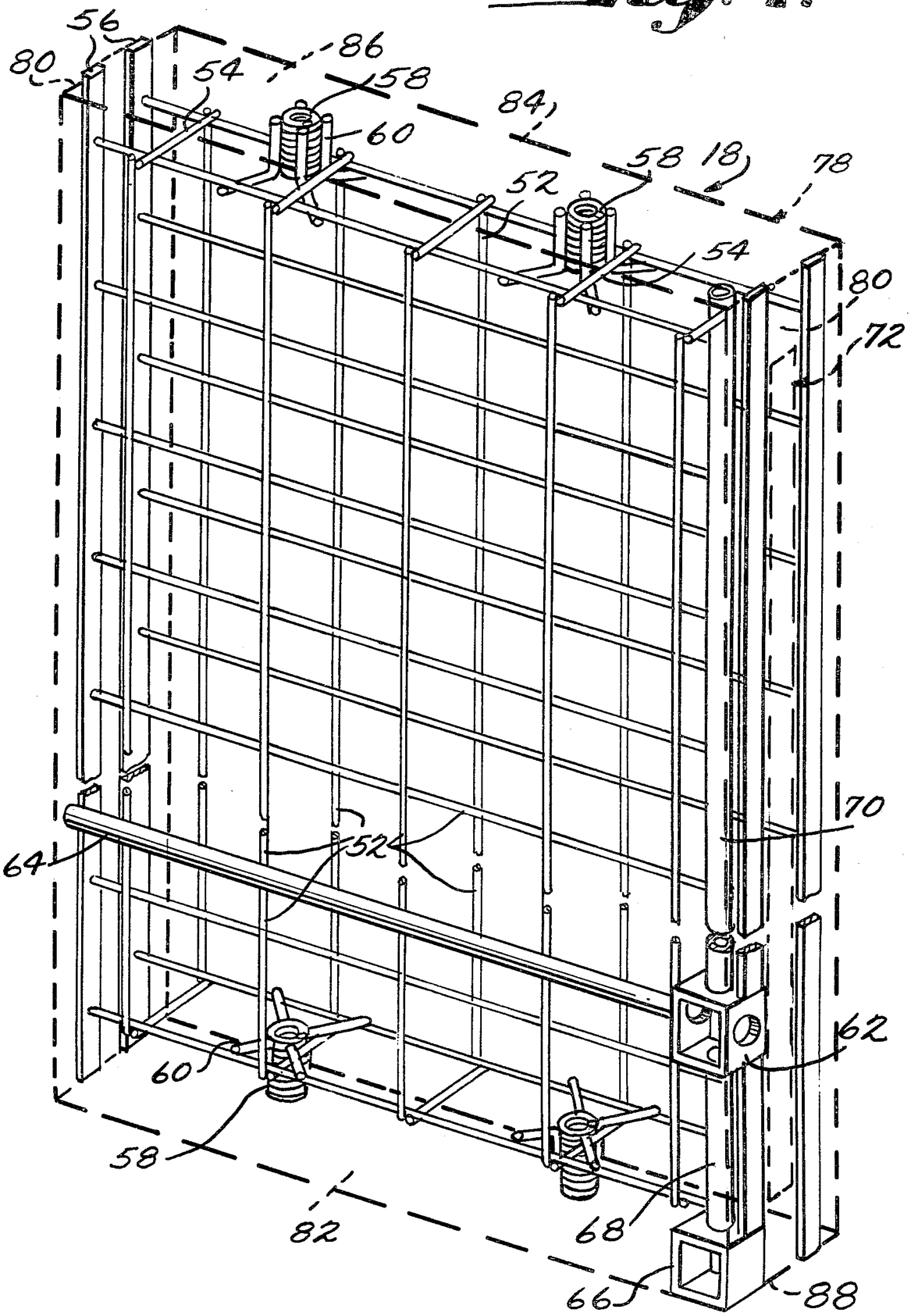
FIG. 4 is a perspective view of a solid vertical panel embodying the principles of the present invention showing the concrete and insulation of the panel in broken lines.

Referring now more particularly to FIG. 4, there is shown therein a solid vertical panel 18 constructed in accordance with the principles of the present invention. Each vertical panel 18 includes a pair of reinforcing rod grids 52 which extend vertically generally throughout the vertical extent of the panel. Preferably the grids are of conventional construction made up of a series of parallel vertically extending rods welded to a corresponding series of parallel horizontally extending rods. The pair of grids 20 is rigidly spaced apart horizontally by a series of spacer rods 54 suitably welded between the upper and lower reinforcing rods of the grids 52.

Welded to the ends of the horizontal rods of each grid 52 is an elongated vertically extending welding bar 56, there being a pair of spaced parallel welding bars 56 at each vertical side edge of the panel. The metal reinforcing structure of the panel 18 is completed by the provision of a plurality of tubular members 58. As shown, the tubular members 58 are preferably in the form of a rod of circular cross-section bent into a helical configuration in which adjacent volutes of the helix are in contact. The interior of each tubular member 58 is thus formed with helical threads. As shown, there are two tubular members 58 secured in vertically extending horizontally spaced relation along the upper edge construction of the panel, each upper tubular member 58 being rigidly secured to the associated reinforcing rod grids 52 by a plurality of L-shaped mounting rods 60 each of which has a vertical leg welded to the exterior periphery of the tubular member and a horizontally extending leg welded to the upper rod of an associated grid 52. As shown, there are four such L-shaped mounting rods provided in conjunction with each tubular member 58. The interior of the tubular member 58 defines sockets which extend downwardly from the upper edge. As shown in FIG. 4, there is a pair of similar tubular members 58 similarly mounted by L-shaped connecting rods 60 along the lower edge construction of the panel.

Each panel 18 also preferably includes an electrical junction box 62 which is preferably of metal or the like. As shown, the junction box 62 is disposed at a vertical position within the panel corresponding to that normally assumed by a wall plug electrical outlet. The box 62 is preferably of conventional metal construction and, as shown, is rigidly secured to the reinforcing structure of the panel by forming a break in the associated welding bar and welding the box 62 thereto. Preferably, the box 62 has a metal tube 64 extending from the side wall thereof opposite from that connected with the welding bar 56 which terminates adjacent the opposite side edge configuration of the panel. In the preferred embodiment shown, a second box 66 is provided below the box 62. This box is suitably welded to the lower end of the welding bar 56 associated with the box 62.

Preferably, a tube 68 extends vertically from the upper wall of the lower box 66 to the lower wall of the box 62 and an upper vertically extending tube 70 extends upwardly from the upper wall of the box 62 to the upper edge construction of the panel. The tubes may be suitably rigidly fixed to the grids if desired. While the tubes 64, 68 and 70 as shown in FIG. 4 are metal tubes which may be utilized, in the manner indicated above, to provide some reinforcing capability, they are primarily provided for the purpose of access for electrical wires through the panel to the box 62. It will be understood that it is within the contemplation of the present invention to utilize the box 66 as a plug outlet which would be presented at the baseboard level, in which case the tube 64 would extend to the inner wall of the box 66 and the box 62 could be eliminated in which case a single tube could replace the tubes 68 and 70. It will also be understood that it is within the contemplation of the present invention to provide electrical wire access to the electrical box by simply casting openings within the concrete which is utilized to form the main body of the panel. Likewise, access may be provided a cast in groove along the lower interior surface of the panel which is normally covered by a baseboard in operation. In this regard, boxes 62 and 66 may likewise be provided as cavities cast in the concrete. It will also be understood that the wiring itself can be cast within the concrete.

In addition to the metal components described above, panel 18 also includes a block of rigid insulating material, generally indicated at 72. Preferably, the insulating material is closed cell foamed polyurethane 74 having an exterior wrapping 76 therearound providing a vapor or moisture barrier. The wrapping preferably is a laminate consisting of paper and metal foil. Wrapped blocks of insulating material of this type are commercially available. In this regard, it will be noted that the block of insulating material 72 is of a size such that its side edges are flush with the outwardly facing surfaces of the welding bars 56 at each side edge construction of the panel 18. Of course, the upper edge of the block is disposed slightly below the upper connecting rods 54 and the lower edge is disposed slightly above the lower connecting rods 54.

Panel 18 is completed by precasting a body of concrete, generally indicated at 78, in contact with the components thus far described. The body of concrete 78 defines with the associated welding bars 56, electrical junction boxes 62 and 66, and insulation block edges, a pair of opposed side edge configurations, indicated at 80, providing recesses outwardly of the welding bars. The welding bars fixed to the ends of the reinforcing rods defining an inner one of the pair of grids 52 have an outer edge surface which faces toward and is recessed from an interior face 82 provided by the body of concrete. The face 82 is preferably smooth and provides the interior wall configuration of the panel when in operative position. The other two welding bars 56 have outer edge portions defining narrow continuous welding surfaces which are recessed from and face outwardly toward an exterior face 84 of the panel defined by the body of concrete 78. The exterior face is preferably cast in a textured configuration, a preferred embodiment being a simulated brick configuration. The simulated brick configuration is preferred, since it can be provided simply in the mold surface during the casting of the panel 18. Other textured configurations can be similarly cast in the face 84. While a cast-in textured surface is preferred, where the economics permit, the surface may be cast with various decorative aggregates, as is well known in the art. In any event, the exterior face 84 defines substantially the entire exterior wall configuration of the panel when in operative position.

Finally, the body of concrete 78 of the panel 18 also defines an upper edge configuration 86 from which the sockets defined by the upper tubular members 58 extend downwardly and a lower edge construction 88 from which the sockets defined by the lower tubular members 58 extend upwardly.

Figure 5:
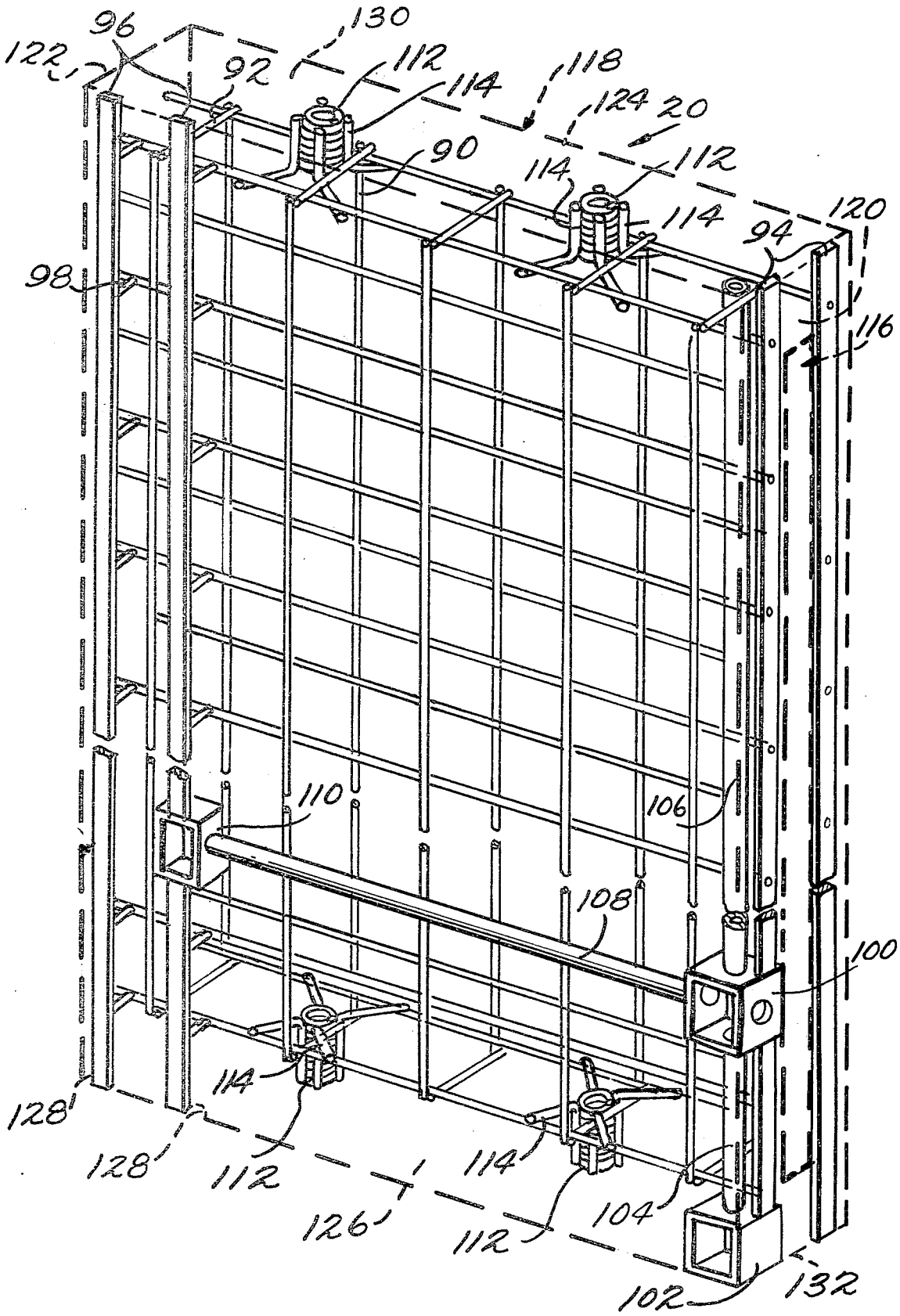
FIG. 5 is a view similar to FIG. 4 of a corner vertical panel embodying the principles of the present invention.

Referring now more particularly to FIG. 5, there is shown therein a corner vertical panel 20 embodying the principles of the present invention. The corner panel 20 is similar in construction to the solid vertical panel 18 and includes a pair of vertically extending inner and outer reinforcing rod grids 90 rigidly spaced apart by upper and lower connecting rods 92. The grids 90 and connecting rods 92 are similar to the grids 50 and connecting rods 54 previously described. Panel 20 includes one pair of welding bars 94 which are similar to one of the pairs of welding bars 56 associated with one of the side edge constructions 80 of the panel 18. Thus, each of the welding bars 94 is rigidly secured as by welding or the like to the adjacent ends of the horizontal rods of an associated grid 90. The corner panel 20 includes a second pair of welding bars 96. However, these bars are not connected to the opposite ends of the horizontal rods of the grids 90 but rather are rigidly connected to the grids by a series of horizontally extending tie rods 98 which position the welding bars 96 so that their outwardly facing surfaces are disposed in a plane extending perpendicular to the plane containing the outwardly facing surfaces of the bars 94.

As before, the inner one of the welding bars 94 is interrupted to include an electrical box 100 spaced upwardly from the bottom of the bar. A second box 102 is fixed to the bottom of the interrupted bar 94. A vertical tube 104 connects the upper wall of the lower box 102 to the lower wall of the box 100 and the upper wall of the latter has a tube 106 extending upwardly therefrom to the upper edge of the panel. It will be understood that electrical boxes 100 and 102 are similar to the boxes 62 and 66 previously described and that the tubes 104 and 106 are similar to the tubes 68 and 70 previously described. Consequently, it will be understood that similar variations may be utilized in the construction thereof. As with box 62, the interior side wall of the box 100 has one end of a tube 108 fixed thereto which extends horizontally toward the opposite end of the panel. Unlike the horizontal tube 64 of panel 18, tube 108 has its opposite end connected to a third box 110. Box 110 is mounted within a break in the inner one of the welding bars 96 in a manner similar to box 110.

Panel 20 also includes a plurality of socket defining tubular members 112 which preferably are similar in construction to the tubular members 58. Members 112 are rigidly secured to the grids by L-shaped mounting rods 114 similar to the L-shaped rods 60 previously described. As with the panel 18, a pair of upper tubular members 112 is suitably fixed in rigid relation to the upper horizontal rods of the grids 90 by a series of L-shaped connecting rods 114 and a similar pair of lower tubular members 112 is fixed to the lower horizontal rods of the grids 90 by a series of L-shaped connecting rods 114.

The panel 20 also includes a block of insulating material, generally indicated at 116, similar to the block of insulation 72. Thus, the block of insulation 116 includes a main body of closed cell foamed polyurethane encased in a wrapping consisting of a laminate of paper and metal foil. One outwardly facing vertical side edge of the block of insulating material 116 is positioned flush with the outwardly facing surfaces of the welding bars 94. The block of insulating material 116 extends substantially throughout the extent of the grids, however its opposite edge is spaced inwardly from the opposite edge construction of the panel.

Corner panel 20 also includes a main body of concrete, generally indicated at 118, which is preferably pre-cast to provide a recessed side edge configuration 120 embodying the welding bars 94 similar to the side edge configuration 80 of the panel 18. The body of concrete 118 includes an opposite side edge face 122 having a textured pre-cast exterior configuration defining the exterior corner of the panel 20. The body of concrete further provides a main exterior face 124 at right angles to the face configuration 122 which is also textured and as indicated with respect to the surface 84 of the panel 18 is preferably of simulated brick texture. Also as before, the body of concrete 118 includes a smooth interior face 126 parallel with the exterior face 124, one side portion of which includes recesses 128 within which the welding bars 96 are positioned. Finally, the body of concrete 118 includes an upper edge configuration 130 from which the sockets defined by the upper tubular members 112 extend downwardly and a lower edge configuration 132 from which the sockets defined by the lower tubular members 112 extend upwardly.

Figure 6:
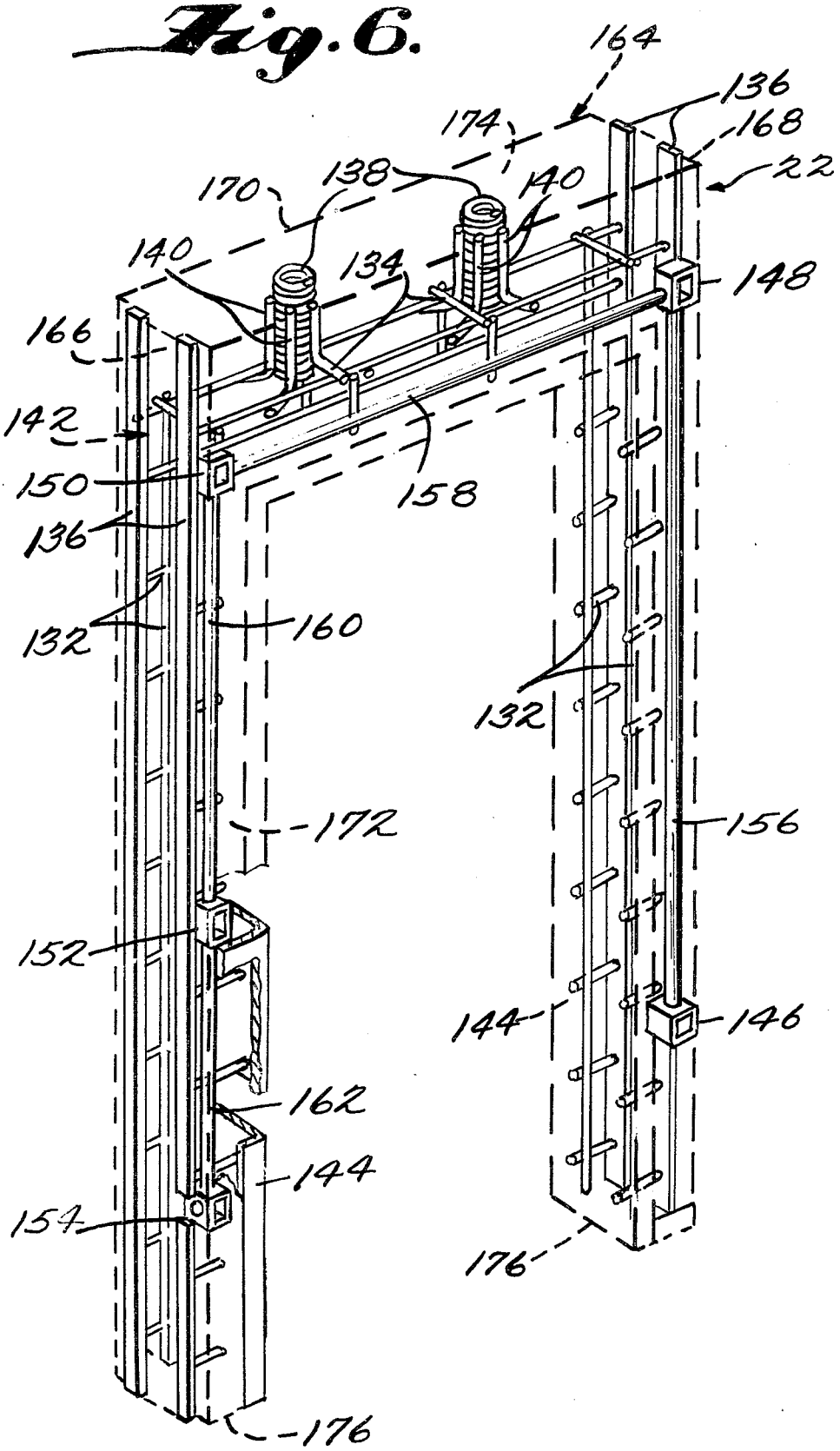
FIG. 6 is a view similar to FIG. 4 of a vertical door panel embodying the principles of the present invention.

Referring now more particularly to FIG. 6, there is shown therein a door panel 22 which is constructed in a manner similar to the panels 18 and 20 previously described. As shown in FIG. 6, the door panel 22 is constructed like the panel 18 to include a pair of grids 132 rigidly interconnected by upper and lower connecting rods 134, four vertically extending welding bars 136 fixed to the ends of the grids, a plurality of vertically extending tubular members 138 fixed to the horizontally extending reinforcing rods of the grids 132 in horizontally spaced relation by a series of L-shaped mounting rods 140, and a block of insulating material 142 made of paper-foil wrapped foamed polyurethane mounted between the grids 132. The door panel 22 differs from the panel 18 in that the grids 132 and insulating material block 142 are cut to provide registering openings and the cut ends of the rods of the grids 132 are welded to the exterior surface of a U-shaped metal door frame 144.

The panel 22 includes an electrical box 146 similar to the box 62 and four other electrical boxes 148, 150, 152 and 154. A vertical tube 156 extends upwardly from the upper wall of the box 146 to the lower wall of the box 148 which is rigidly mounted within the associated welding bar 136 in a manner similar to that previously described. From the inner side wall of the box 148, a tube 158 extends horizontally to the inner side wall of the box 150. A tube 160 is connected with the lower wall of the box 150 and extends downwardly therefrom. Boxes 148 and 150 thus serve as a means to enable an electrical wire to be extended from and to the vertical tubes 156 and 160 through the horizontal tube 158. Vertical tube 160 extends to the upper wall of the box 152 which is positioned vertically within the panel at a position normally occupied by a light switch. The lower wall of the box 152 has a tube 162 extending vertically downwardly therefrom to the upper wall of the box 154 which is positioned at a level corresponding with the level of the box 146.

As before, the rigidly interconnected metal parts and block of insulating material of the panel have a body of concrete 164 hardened in contact therewith so as to provide opposed recessed side edge configurations 166 and 168, a simulated brick textured exterior face 170, a smooth interior face 172, an upper end configuration 174 from which the sockets defined by the tubular members 138 extend downwardly and spaced lower end configurations 176.

It will be understood that the window panels 24 have a construction identical to the construction of the solid panels 18 except that the grids and block of insulation are cut to provide registering openings therein and a metal window frame 178 (see FIG. 2) is welded to the cut ends of the reinforcing rods of the grids in a manner similar to the door frame 144 of the door panel 22.

Figure 7:
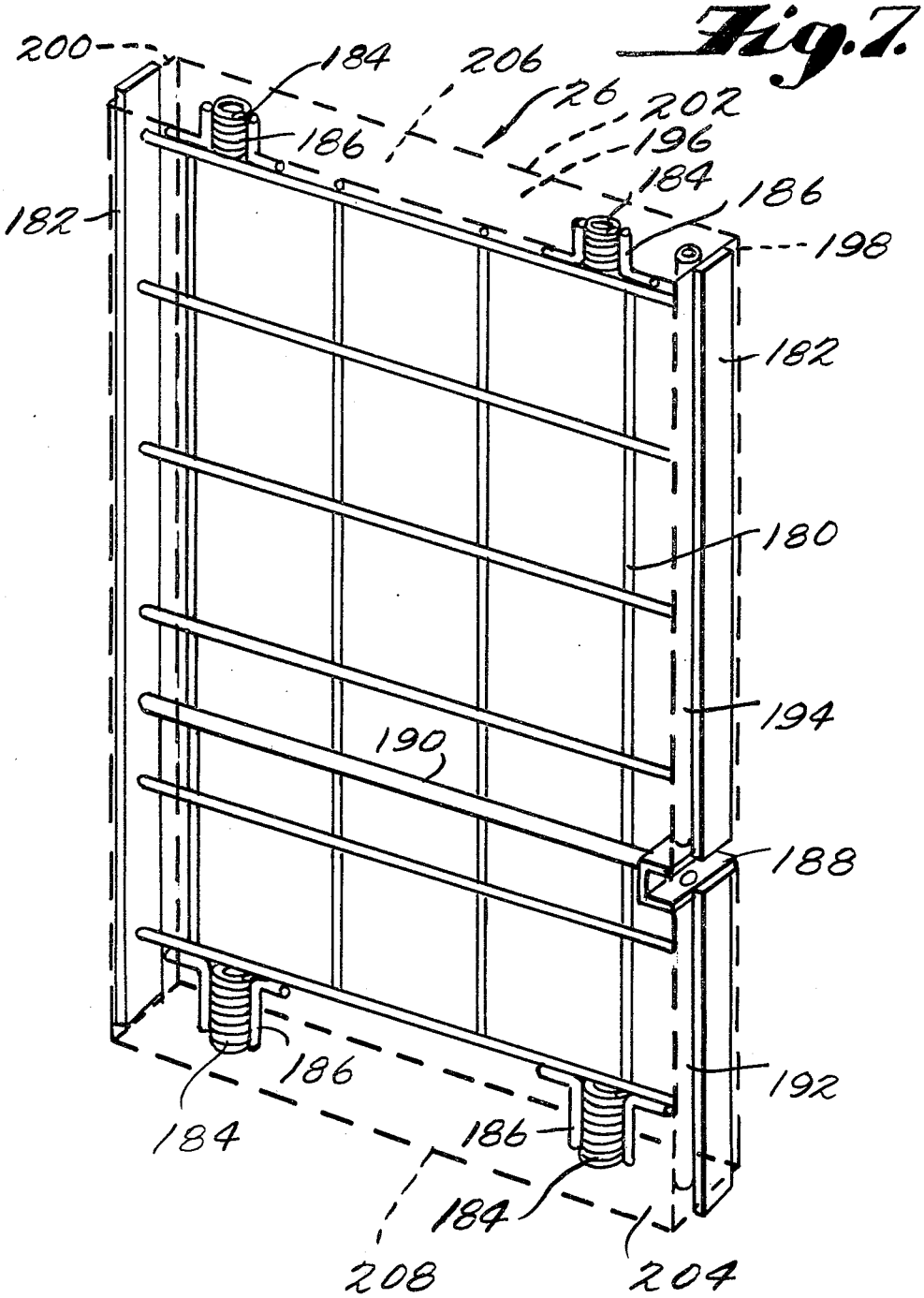
FIG. 7 is a view similar to FIG. 4 showing a load bearing interior vertical panel embodying the principles of the present invention.

Referring now more particularly to FIG. 7, there is shown therein a load bearing interior panel 26 which is constructed in accordance with the principles of the present invention. Basically, the load bearing interior panels 26 are constructed similarly to the exterior panels except that they are of a lesser thickness (4" as compared with 8") and hence they do not include any block of insulation and have only one reinforcing rod grid 180 rather than the pair of grids provided in the exterior vertical panels 18. Similarly, only a single welding bar 182 is provided along each side of the single grid. Like the exterior panel 18, the interior panel 26 includes a plurality of vertically extending tubular members 184, a pair of which is rigidly mounted on the upper horizontal rod of the grid 180 in horizontally spaced relation by a series of L-shaped mounting rods 186. The panel 26 also includes a pair of lower tubular members 184 rigidly secured to the lower horizontal connecting rod of the grid 180 by L-shaped mounting rods 186.

The panel 26 includes an electrical box 188 which is similar to the box 62 of the panel 18 except that it extends the entire width of the panel and is open at both ends. The box 188 is positioned vertically at a level similar to the level of the box 62 and has its inner side wall connected with one end of a tube 190 which extends to the welding bar 182 at the other side of the panel. A lower vertical tube 192 extends downwardly from the lower wall of the box 188 to the lower surface of the panel and an upper vertical tube 194 extends from the upper wall of the box 188 to the upper end of the panel.

As before, the metal components thus far described have a body of concrete 196 hardened in contact therewith so as to provide opposite recessed side edges 198 and 200, opposed wall faces 202 and 204 which preferably are smooth and provide substantially the entire wall configurations of the panel, an upper end configuration 206 from which the sockets defined by the upper tubular members 184 extend downwardly and a lower end edge configuration 208 from which the sockets defined by the lower tubular members 184 extend upwardly.

It will be understood that the interior door panels 28 are constructed in a manner similar to the panel 26 except that the grid 180 is cut so as to provide an opening therethrough and the cut ends of the grid are welded to the exterior of a door frame 210 (see FIG. 2). In addition, additional electrical boxes suitable to provide access for wires to extend over and around the door frame are provided in a manner similar to that described above with respect to the exterior door panel 22.

While interior window panels normally are not contemplated, nevertheless, where needed, they would be constructed in a manner similar to the panels 26 modified to include a window frame in a manner similar to that described above with respect to the exterior window panels 26.

Figure 8:
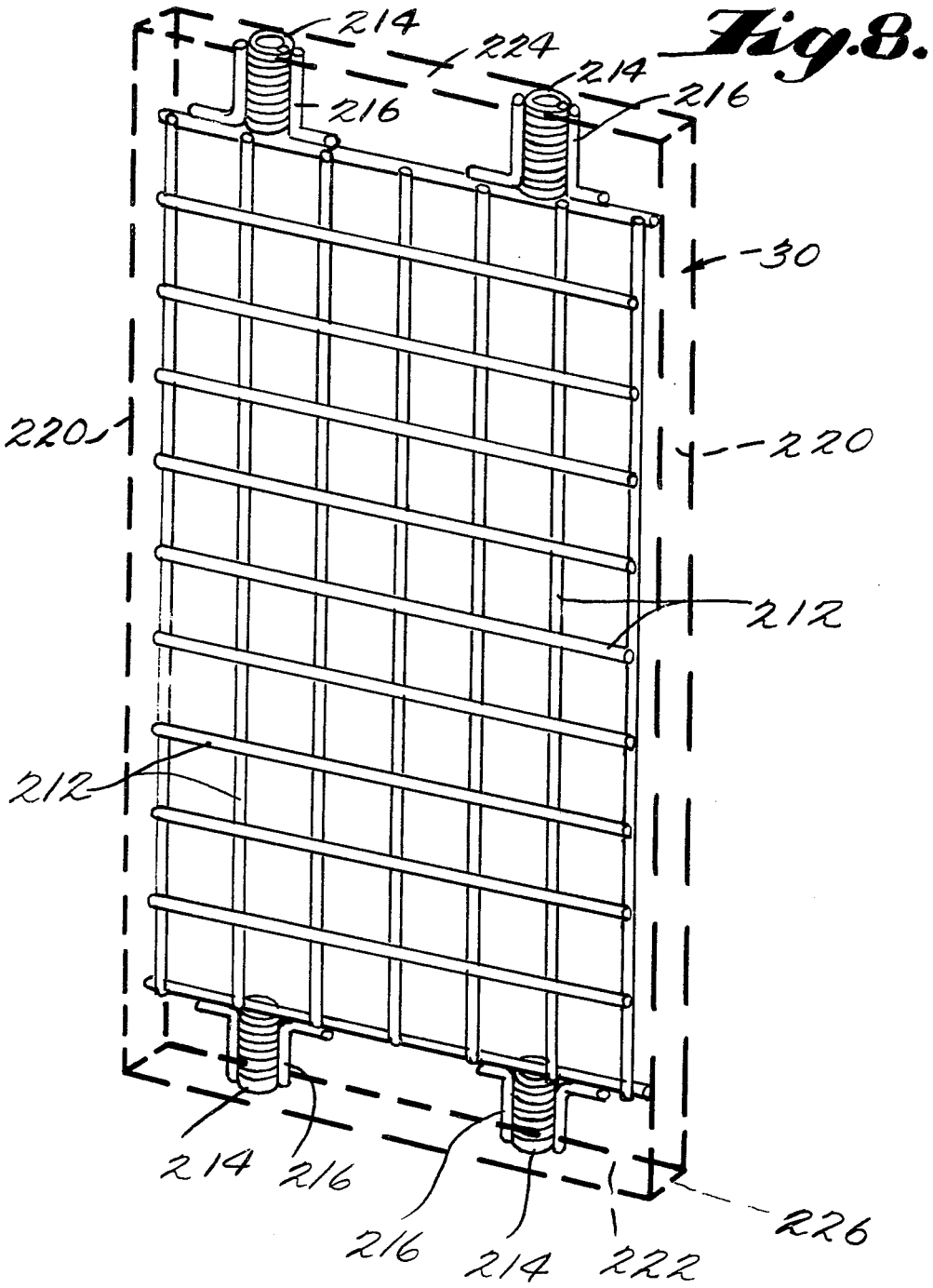
FIG. 8 is a view similar to FIG. 4 showing a vertical partition panel embodying the principles of the present invention.

Referring now more particularly to FIG. 8, there is shown therein a partition panel 30 embodying the principles of the present invention. The partition panel 30 is similar to the interior load bearing panel 26 except that it has a thickness which is even smaller (2" as compared with 4"). In addition, the partition panel 30 does not include welding bars, nor is it provided with electrical boxes or wire access tubes. As shown, the panel 30 includes a vertically extending reinforcing rod grid 212 having a pair of upper and lower tubular members 214 rigidly secured to the upper and lower horizontal rods of the grid by a pair of L-shaped mounting rods 216. A body of concrete 218 is hardened in contact with the metal components thus far described so as to provide opposed side edges 220, opposed faces 222 which are preferably smooth and provide the wall configuration of the panel, an upper end configuration 224 from which the sockets defined by the upper tubular members extend downwardly and a lower end edge configuration 226 from which the sockets defined by the lower tubular members extend upwardly.

Figure 9:
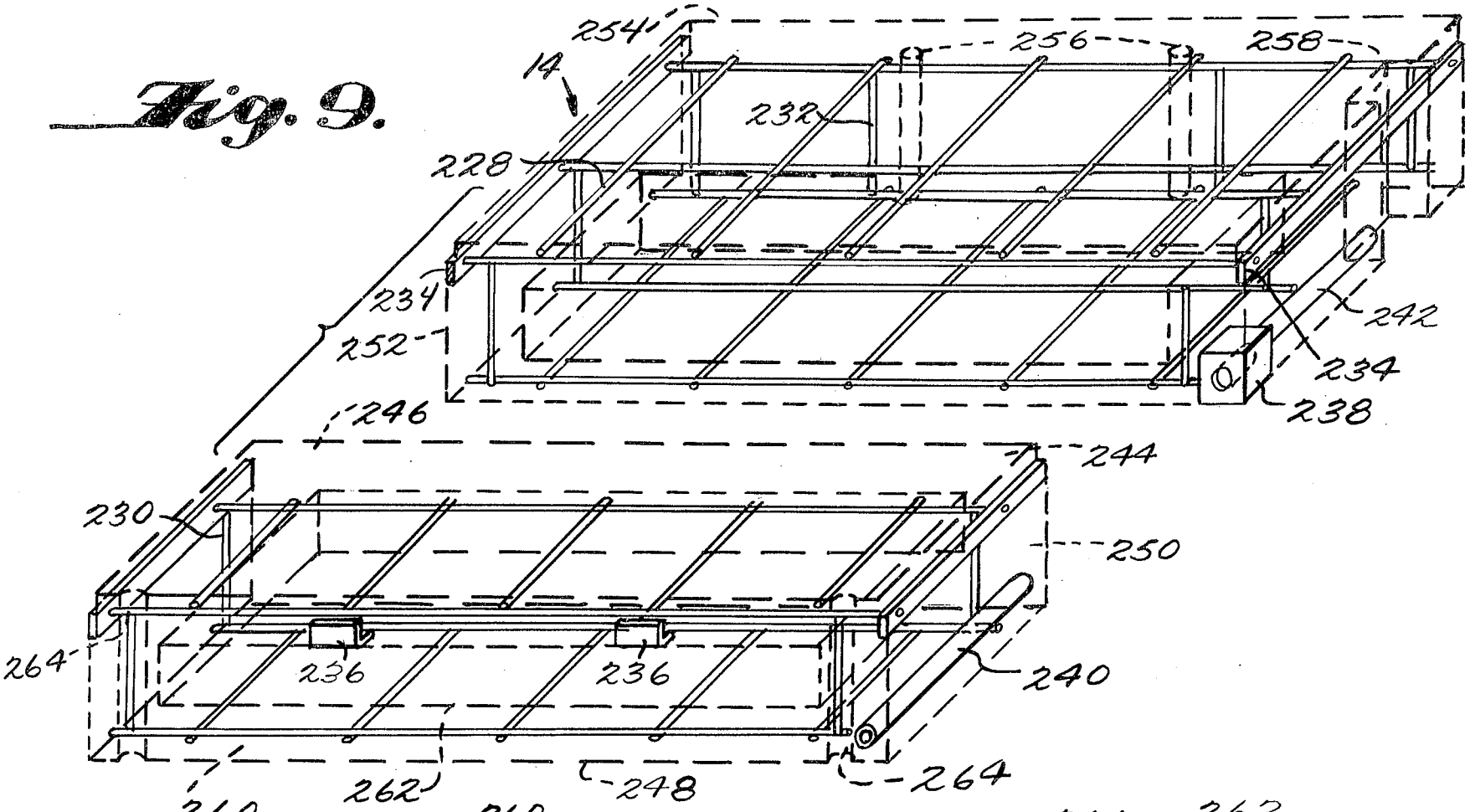
FIG. 9 is a view similar to FIG. 4 of a horizontal ceiling/floor horizontal panel embodying the principles of the present invention.
Figure 10:
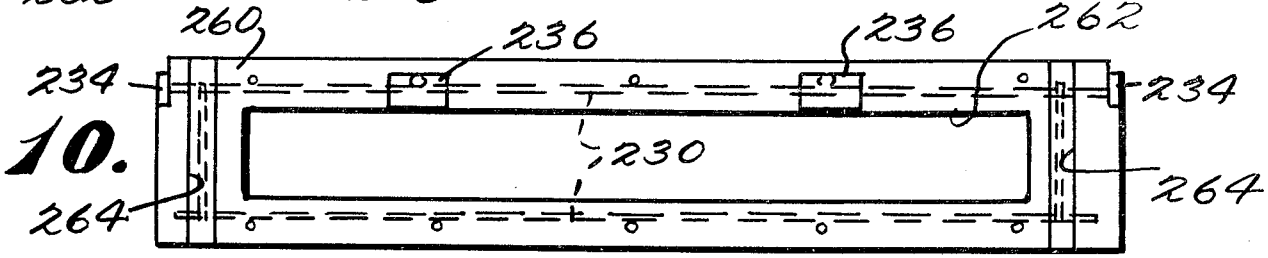
FIG. 10 is an end view of the panel shown in FIG. 9.

Referring now more particularly to FIGS. 9 and 10, there is shown therein a horizontal floor/ceiling panel 14 which embodies the principles of the present invention. The panel is similar to the exterior vertical panels previously described in that it includes a pair of reinforcing rod grids 228 which extend horizontally substantially throughout the entire panel. The pair of grids is mounted in horizontally spaced relation by a series of connecting rods 230 welded along the rods defining the sides of the grids. Preferably, there are additional connecting rods 232 along the grids defining one end thereof. Rigidly secured to the ends of the cross rods defining the upper grid is a pair of welding bars 234 which are of a construction similar to the welding bars previously described in connection with the exterior vertical panels. Welded to the ends of certain of the longitudinal rods defining the upper grid 228 is a pair of angle iron brackets 236.

As before, there is provided an electrical junction box 238 intermediate the ends of the panel having its inner side wall rigidly connected to an end of an associated cross rod of the lower grid 228. The lower wall of the box 238 is open and one end wall thereof is connected to one end of a tube 240 which extends horizontally therefrom to the adjacent end of the panel. A second tube 242 extends from the opposite end wall and terminates at a position spaced from the opposite end of the panel.

The panel 14 includes a body of concrete 244 which is hardened into contact with the metal components thus far described so as to provide an upper horizontal floor face 246, a lower horizontally extending ceiling face 248, and opposed side edge configurations 250 and 252 recessed along the upper edge thereof so as to expose the narrow continuous upper edge of the welding bars 234 in a manner similar to the welding bars previously described. The body of concrete 244 also includes an exterior end wall face 254 which, like the exterior faces provided in the exterior vertical panels is preferably cast with a simulated brick texture.

Formed in the body of concrete 244 adjacent the exterior face 254 is a pair of connecting rod receiving cylindrical openings 256 which extend completely vertically through the body of concrete from the floor face 246 to the ceiling face 248 thereof. In addition, an electrical wire access opening 258 is formed therein at a position so as to communicate with the end of the tube 242. The wire access opening 258 extends vertically completely through the body of concrete from the floor face 246 to the ceiling face 248 thereof.

The body of concrete 244 provides an end face 260 at the end thereof opposite from the exterior face 254 and also defines a cavity 262 of substantial volume which extends inwardly from the face 260 toward the face 254 to a position generally in alignment with the end of the tube 242. The width of the cavity 262 is somewhat less than the width between the side connecting rods 230. Finally, the end face 260 has formed therein on opposite sides of the cavity 262 a pair of semicylindrical grooves or openings 264 which extend vertically completely through the end surface from the floor face to the ceiling face thereof.

Figure 11:
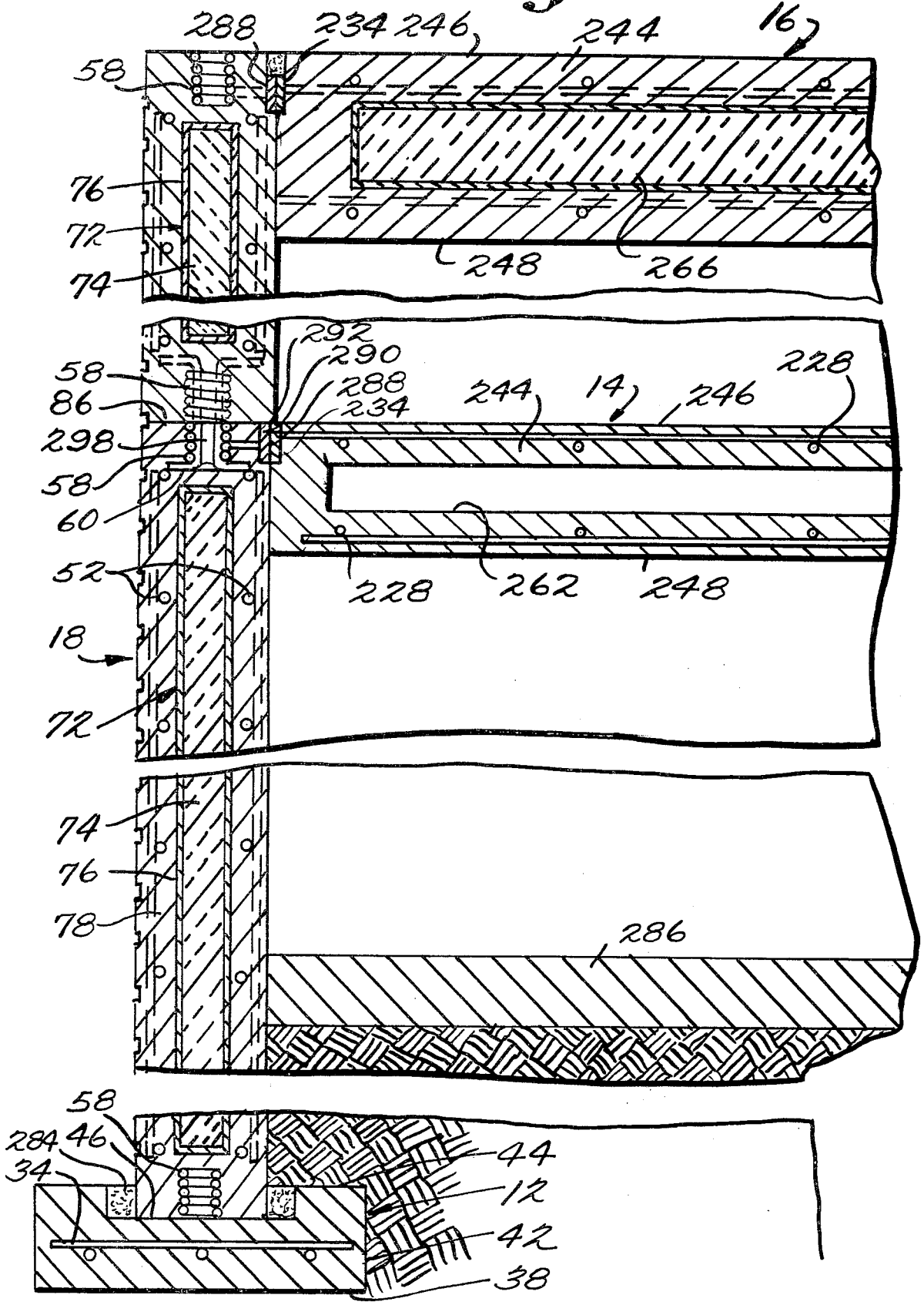
FIG. 11 is an enlarged fragmentary cross-sectional view taken along the line 11—11 of FIG. 2.

With reference to FIG. 11, the ceiling/roof panel 16 is constructed in substantially identical fashion to the floor/ceiling panel 14 except that its height is greater (9.6" as compared with 8") and the cavity 262 thereof is filled with a block of rigid insulating material 266. The insulating material 266 is similar to that previously described in that it embodies closed cell foamed polyurethane wrapped in a laminate consisting of paper and metal foil.

With the above in mind, the installation of the illustrative building 10 utilizing pre-cast panels of the type described above includes initially a mounting of a plurality of footing or footer panels 12 within the ground on which the building is to be erected. The utilization of pre-cast footer panels is a desirable feature in that it eliminates the necessity to pour concrete footings on site. It is necessary, however, to prepare a bed of gravel and sand, indicated at 268 in FIG. 16, at a suitable level below the ground conforming to the local building code. After the bed 268 has been prepared, the footer panels 12 are lowered onto the bed by a crane having a lifting sling connected therewith and to two of the hooks 50 extending outwardly from opposite corners of the footer panel. As shown in FIG. 3, successive footer panels are mounted in end-to-end relation so that their longitudinal grooves 46 are in alignment. When the installation reaches a corner, the next adjacent footer panel is mounted so that its longitudinal groove 46 is aligned with the transverse groove 48 of the corner footer panel. The transverse grooves in all of the footer panels between the corner footer panels enable intermediate interior vertical walls to be extended inwardly where additional footer panels are installed.

Figure 16:
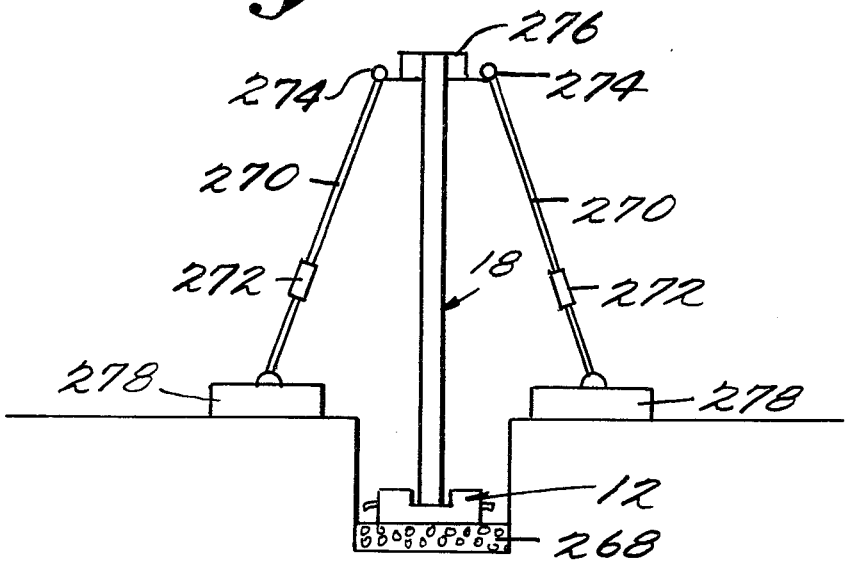
FIG. 16 is an end view illustrating how the initial vertical panels are erected on the footer panels.
Figure 17:
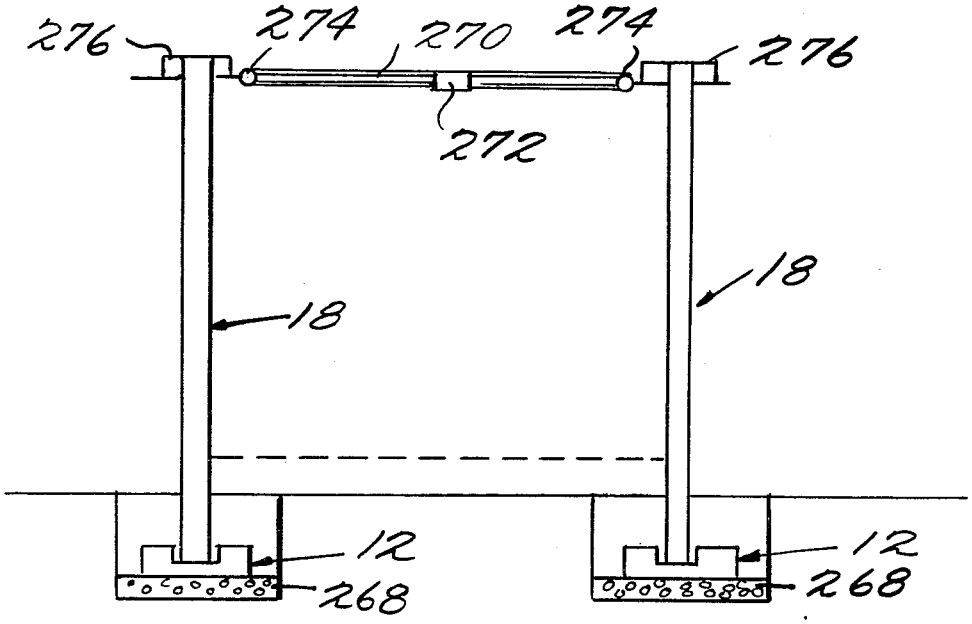
FIG. 17 is a view illustrating the erection of subsequent vertical panels on the footer panels.

Referring now more particularly to FIGS. 16 and 17, after the footer panels 12 have been installed the exterior vertical panels are then installed within the aligned grooves of the footer panels. It will be noted that the grooves are wider than the width of the panels so that close tolerances need not be maintained in the event that a tight fit were to be provided. In addition, the arrangement of footer panels 12 insures that each vertical panel will rest partially on each of two adjacent footer panels.

An important part of the present invention is the manner in which the vertical panels are lifted and lowered into their operative position of installation. As previously indicated, each of the vertical panels is provided with a pair of tubular members which define a pair of internally threaded sockets extending downwardly from the upper edge construction of the panel. It is greatly preferred to handle the panels even at the precasting location by means of lifting devices (not shown) threadedly engaged within the upwardly opening threaded sockets. Such lifting devices may embody a stud or cylindrical element threaded at its lower end and receiving a swivel collar on its upper end. Connected to the swivel collar is a hook or eye through which a cable can be extended. By utilizing two sockets to lift the panels a better stabilization of the panel is maintained and the lifting force distribution to the internal configuration of the panel is most favorable. It is of further significance to appreciate that after the vertical panel has been installed or lowered into its operative position, the lifting devices can simply be removed from their sockets and the sockets can then become a part of a subsequent interconnected joint with panels from above in a manner which will hereinafter be more fully described.

The initial vertical wall panel 18 which is erected first is preferably at the corridor or center of the building, with erection proceeding toward the sides. The initial panel is leveled by supporting it from both sides by means of a pair of pipe struts 270 fitted with turnbuckles 272, as shown in FIG. 16. Each pipe strut 270 is connected at its upper end through a ball joint 274 with one end of a C-clamp 276 fixed to the upper marginal edge portion of the panel 18. The lower end of each pipe strut 270 is supported on the ground and its horizontal movement is restrained by placing some heavy load, as for example a concrete block 278, in supporting relation to it. The vertical alignment of the panel 18 is then attained by adjusting the turnbuckles 272 of the pipe struts 270.

FIG. 17 illustrates the manner in which a second row of foundation wall panels can be leveled after the initial row of panels has been erected. In this case, a pipe strut 270 having a turnbuckle 272 embodied therein is fixed horizontally between the initially installed wall and the panels 18 to be installed in the second row of panels. Here again, each end of the pipe strut 270 is connected through a ball joint 274 to a C-clamp 276 suitably fixed to the upper marginal edge portion of the associated panel.

Adjustment is attained by suitably turning the turnbuckle 272. Erection of the vertical panels in the upper stories is followed in the same manner as in the first floor level, the sequence of wall panel erection should start from the middle toward the sides or ends of a building.

Figure 13:
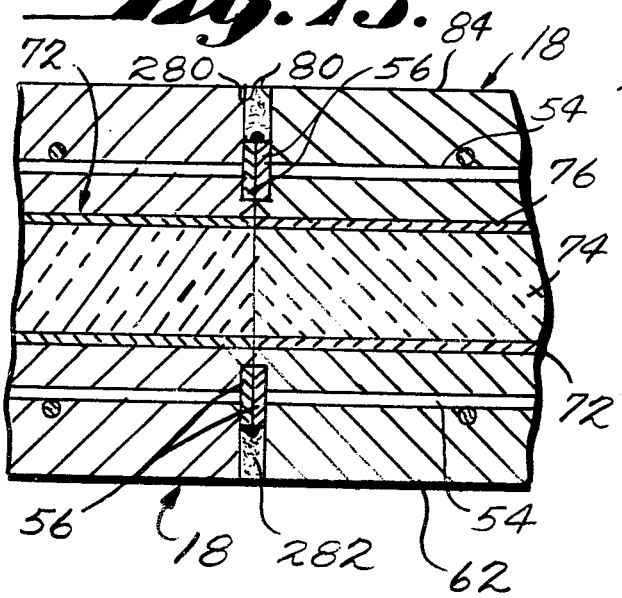
FIG. 13 is an enlarged fragmentary cross-sectional view showing the joint between two vertical panels after installation.

It will be understood that side-by-side vertical panels are secured together by welding the abutting welding bars thereof together. A typical joint between two exterior vertical panels 18 is illustrated in FIG. 13. Preferably, the weld along the exteriorly outwardly facing surfaces of the outer abutting pair of welding bars 56 is a continuous weld made by proceeding from the bottom up. After the weld has been completed the recesses formed in the adjacent side edge configurations 80 of the panels are filled with grouting as indicated at 280. The abutting welding bars 56 providing the interiorly outwardly facing welding surfaces can be spot welded although continuous welding is regarded to be desirable. Like the exterior joint, the interior recess is grouted, as indicated at 282, after welding to finish the joint.

With reference to FIG. 13, it will be noted that the exposed side edges of the blocks 72 of insulating material abut one another so that there is provided a substantially continuous insulating barrier throughout the entire wall structure. The interconnection between a vertical panel 18 and a corner panel 20 is accomplished in substantially identical fashion since the welding bars 96 of the corner panel will abut the welding bars 56 of the panel 18 substantially as shown in FIG. 13. Likewise, the side-by-side interconnection of exterior vertical panels 18 with exterior door panels 22 or exterior window panels 24 is effected in a similar manner. The mounting of interior load bearing panels 26 and 28 in side-by-side relation is accomplished in a similar fashion with the welding of opposite outwardly facing abutting edges being preferably at spots, but a continuous arrangement may be utilized. After welding the recesses are suitably grouted, as before.

It will be noted that after the vertical panels have been mounted within the grooves of the footer panels 12 the excess width of the grooves is filled with grouting, as indicated at 284 in FIG. 11. As shown in FIG. 11, the lower socket defining tubular members 58 of the exterior vertical panels 18 are not utilized. Hence, in many instances these tubular members may be omitted. The mounting of the lower marginal edge portion of the vertical panels within the grooves of the footer panels 12 and the subsequent grouting 284 provided insures that there is an adequate shear resisting force in the junction. However, areas which are subject to earthquake and in those instances where additional strength may be desired, tubular members 58 may be rigidly fixed within the footer panels 12 to provide sockets which extend downwardly from the surface defining the bottom grooves. Where such sockets are provided, exterior hooks 50 can be eliminated and the footer panels can be lifted by threadedly engaging lifting devices in the socket and utilizing a crane to raise and lower the lifting devices. The lifting device may be in the form of a swivel hook or the like, with wires interconnecting two such swivel hooks to provide stability, as aforesaid.

With reference to FIG. 11, it will be noted that the vertical panels 18 which are utilized to form the exterior foundation walls of the building 10 have a vertical extent which is approximately 4' greater than the floor-to-ceiling height of the basement. The basement floor as previously indicated can be formed of panels but preferably consists essentially of a poured slab 286. As shown in FIG. 11, the vertical panels 18 forming the north-/south walls extend upwardly from the exterior surface of the basement floor slab 286 a distance equal to the height of the ceiling. The vertical panels forming the east/west walls of the building have a vertical height which is greater by an amount equal to the thickness of the floor/ceiling panels 14. The east/west panels also are provided with a horizontal welding bar 288 suitably welded to the adjacent grid which extends along the interior face 86 in recessed relation with respect to the upper edge construction 84 thereof.

With this construction, horizontal floor/ceiling panels 14 are installed by utilizing lifting slings about the central portion thereof and lowering the same down so that the exterior end portion defining the face 254 is aligned with the exterior face of the vertical panel 18 therebelow and the end portion defining the end face 260 overlies and rests on the upper one-half of the edge configuration 206 of the interior load bearing panel 26. After removing the sling the panel can be moved horizontally in supported relation until its adjacent welding bar 234 is disposed in abutment with the welding bar 288. The upwardly facing narrow surfaces of the abutting welding bars can then be welded preferably continuously but with support welds if desired as indicated at 290. After welding, the joint may be grouted as indicated at 292 in FIG. 11. The remaining floor/ceiling panels are then mounted in place and a similar joint is provided between each pair of side-by-side horizontal panels 14.

Figure 12:
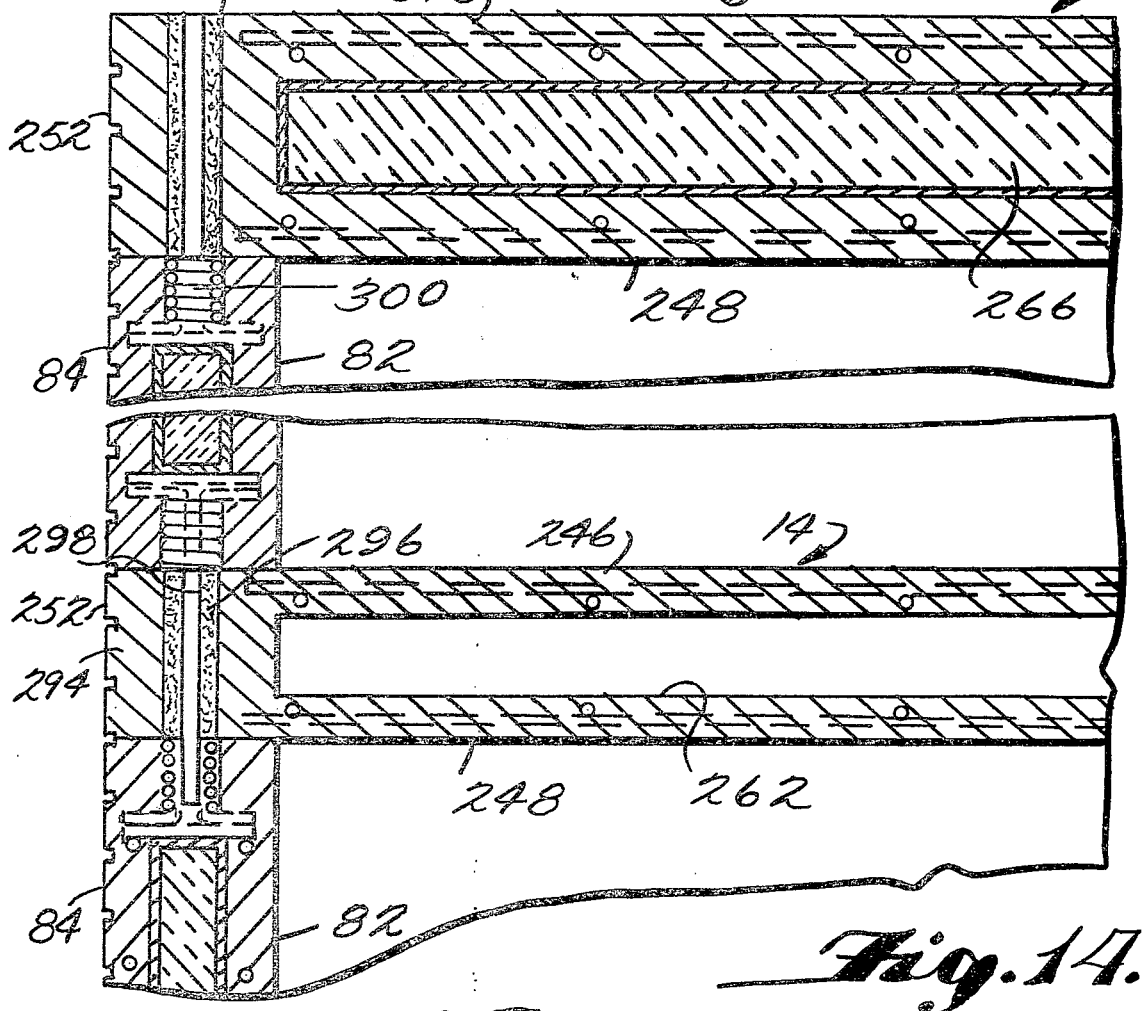
FIG. 12 is an enlarged fragmentary cross-sectional view taken along the line 12—12 of FIG. 2.

FIG. 12 illustrates a modification of the arrangement illustrated in FIG. 11 in which all of the exterior vertical panels defining the exterior foundation wall have equal vertical heights in which case certain side ones of the floor/ceiling panels 14 are provided with an extended width or a side extension, as indicated at 294, in which case the welding bar 234 of the associated side is eliminated. The associated side edge configuration, as for example, the side edge configuration 252, is modified so as to present a textured face conforming with the textured exterior face of the panel 18, such as a simulated brick. Moreover, a series of cylindrical openings 296 is formed in the side extension 294 which extend completely therethrough from the floor face 246 to the ceiling face 248 thereof. The openings 296 are positioned so that when the exterior side edge face 252 of the panel is aligned with the exterior face of the panel 18 therebelow, openings 296 will be aligned with the sockets defined by the upper tubular members of the panels therebelow.

After the floor/ceiling panels have been appropriately installed, the vertical walls defining the first story of the building 10 are installed next in the manner previously indicated. In this regard it will be noted that prior to lowering each upper vertical panel into its operative position through the use of the lifting devices removably engaged in the upper sockets, a connecting rod 298 is fixedly threadedly engaged within each of the sockets provided by the lower pair of tubular members. The portion of the connecting rods 298 extending below the socket is of a reduced diameter which, in turn, is less than the diameter of the openings 256 (or 296 in the case of the FIG. 12 embodiment). Consequently, prior to lowering the upper vertical panels into operative position, the upwardly facing sockets and registering openings are partly filled with grouting. Enough space is left in the upper part of the openings to take care of the connecting rod displacement as the connecting rod is lowered therein. In addition, it should be noted that a mastic material seal can be provided between the interengaging portions of the vertical and horizontal panels. The connecting rods 298 employed in effecting the connection of the upper east/west vertical panels with the corresponding lower east/west panels in the arrangement shown in FIG. 11 are shorter than those required in the other connections, since it merely needs to extend into the upwardly facing socket of the lower vertical panel, as is clearly shown in FIG. 11.

Figure 15:
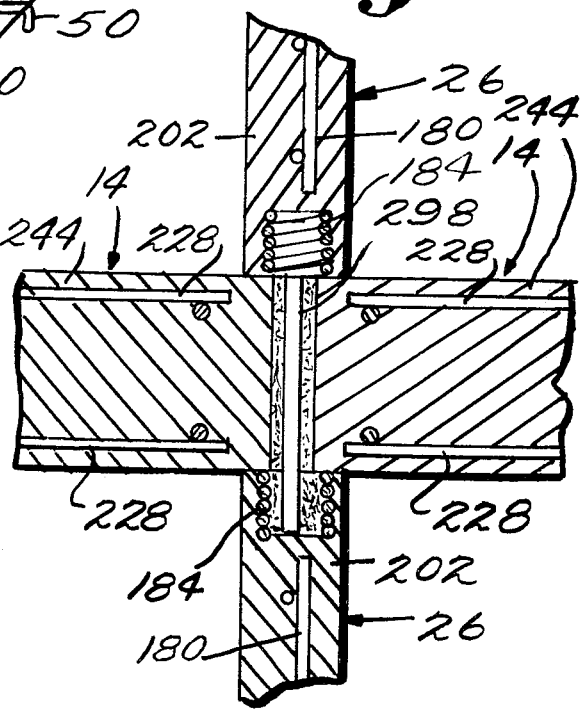
FIG. 15 is an enlarged fragmentary cross-sectional view taken along the line 15—15 of FIG. 2.

FIG. 15 illustrates the connection between the inner end portions of two abutting horizontal panels 14 between two aligned upper and lower load bearing panels 26. In this case, the upper and lower tubular members 186 of the load bearing panels are spaced apart near the side edge constructions so as to align with the semicylindrical grooves 264 of the panels 14. In this case the joint becomes one which is the same as that provided by the pin 298 and it will be noted that the joint is formed in the same fashion utilizing grouting.

After the first story vertical panels have been installed, the ceiling/roof panels 16 are installed in a manner similar to the installation of the floor/ceiling panels 14. However, pin connections are accomplished in this case by pins 300 having their lower ends fixedly threaded within the upper sockets and having a portion of reduced diameter engaged within openings 256 (or 296 in the embodiment shown in FIG. 12). After installation, the joint can be grouted, as indicated at 302 in FIG. 12, from above.

A significant advantage of the building 10 constructed in accordance with the principles of the present invention is that it utilizes substantially entirely modular pre-cast reinforced concrete panels. Exterior vertical panels provide an 8" wall thickness in one pour, with 3" insulated center core. The block of insulation itself has an insulating factor of R24 and the R factor of the entire panel is about 15. It is of great significance that the exterior vertical panels provide with one pour a textured exterior face (4'×8" or more) and a smooth interior face, both of which can be utilized without further coatings where the concrete is suitably colored. In either event, the only coating which need by applied is a simple coating of paint or wall paper on the smooth interior surface. The maximum weight of a panel is only approximately 1.3 tons, rendering each capable of being handled by commonly available local construction equipment such as a portable crane or the like. The provision of internally threaded sockets in the exterior edges of the vertical panels enables these panels to be easily handled and at the same time effectively coupled.

The side-by-side joints of the vertical panels are designed to maintain structural integrity of the system as a whole by utilizing simple one-piece welding techniques which are fast and economical. By integrating the welding bars which serve to interconnect side-by-side panels with the reinforcing grids within each panel there is provided a foolproof continuity of reinforcement throughout the walls and floors after the joints have been welded together. Since the panels are of reinforced concrete as opposed to prestressed units, they can be manufactured in many local installations at an economical cost. While pre-casting is preferred, it is within the contemplation of the present invention, at least with respect to the exterior vertical panels, to install the metal work and then shoot on or gunite the concrete with the block of insulating creating the backdrop.

The pre-cast footer panels provide significant advantages, including all weather installation. It will be understood, however, as aforesaid, that the building utilizing the other panels may be provided with poured onsite footings of a conventional nature. Similarly, in lieu of the ceiling/roof panels 16, a conventional roof and ceiling construction, such as a pitched roof formed of trusses could be utilized. Indeed, the present invention contemplates buildings where only the exterior vertical walls are provided by panels in accordance with the present invention or buildings where the floor/ceiling is provided by the panels, or both.

A primary consideration of the present invention in terms of providing buildings with an economical cost is that substantial savings can be made in the labor costs heretofore required. This aspect is particularly true with respect to the labor required in finishing both the exterior and interior wall surfaces and it is likewise secured in providing the necessary services within the building such as electrical outlets, switches and light sockets, plumbing outlets and piping and temperature conditioning of the room air. With respect to the electrical wiring it will be noted that the exterior panels provide for a continuous tubular electrical wire access horizontally to each of the outlet plugs thereof. In addition, there is provided vertical access in the solid panels 18 and window panels 24. The vertical access aligns with the vertical access openings 258 of the floor/ceiling panels 14 which, in turn, provides access to the junction box in the floor/ceiling panels as well as the ceiling/roof panels. In this regard, it will be noted that the vertical access openings of the ceiling panels do not extend completely therethrough but only to the insulation from below. With this arrangement the entire wiring of a building can be accomplished simply by threading wires into the continuous network of tubing provided. In addition there are more than ample electrical junction boxes to provide for outlet plugs including interior walls, light switches adjacent doors including interior doors and ceiling fixtures if desired.

Plumbing can be readily installed by extending the pipes through selected cavities 262 in the floor/ceiling panels 14. In addition, plumbing panels 34 are contemplated which are constructed in a manner similar to the floor/ceiling panels with the cavity being open at both vertically extending ends and the thickness of the cavity being extended sufficient to receive pipes of a diameter of the size utilized in waste pipes. Generally, the plumbing can be installed by drilling holes through the floor/-ceiling panel into communication with the central cavity, although it is within the contemplation of the present invention to pre-cast openings for plumbing pipes in the body of concrete which would eliminate the need for such drilling.

Figure 14:
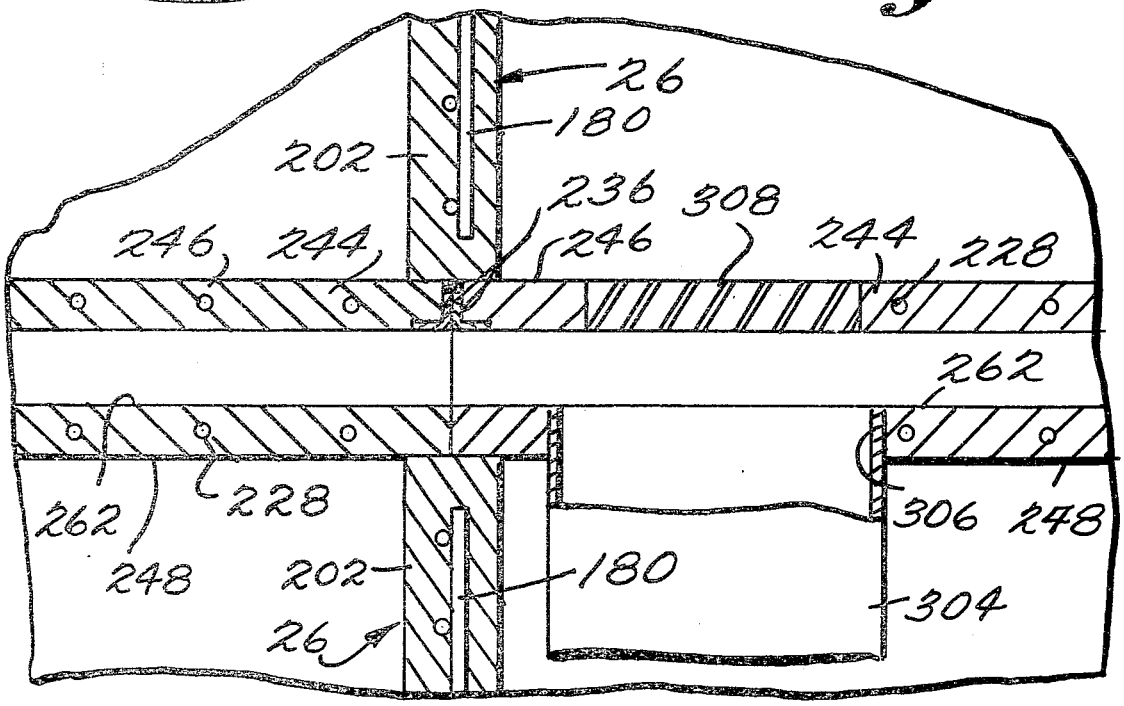
FIG. 14 is an enlarged fragmentary cross-sectional view taken along the line 14—14 of FIG. 2.

It is also important to note that the cavities 262 provide a duct system for conveyance of heated or cooled air from a furnace/air conditioning unit to the rooms and for return air from the rooms back to the furnace/air conditioning unit. FIG. 14 illustrates a connection of an outlet duct 304 of a furnace/air conditioning unit to a pair of aligned cavities 262 through an opening 306 in the lower portion of the panel 14. It will be understood that by providing additional openings with suitable floor or ceiling registers 308 therein (see FIG. 2) which communicate with the spaces 262 the temperature conditioned air from the duct section can be conveyed to the rooms within which the registers are mounted.

It will be understood that for purposes of return air conveyance the cavities 262 associated with an adjacent pair of floor/ceiling panels 14 may be utilized with the cavity thereof having a return air register 310 (see FIG. 2) and a return duct connection similar to that shown in FIG. 14.

Figure 18:
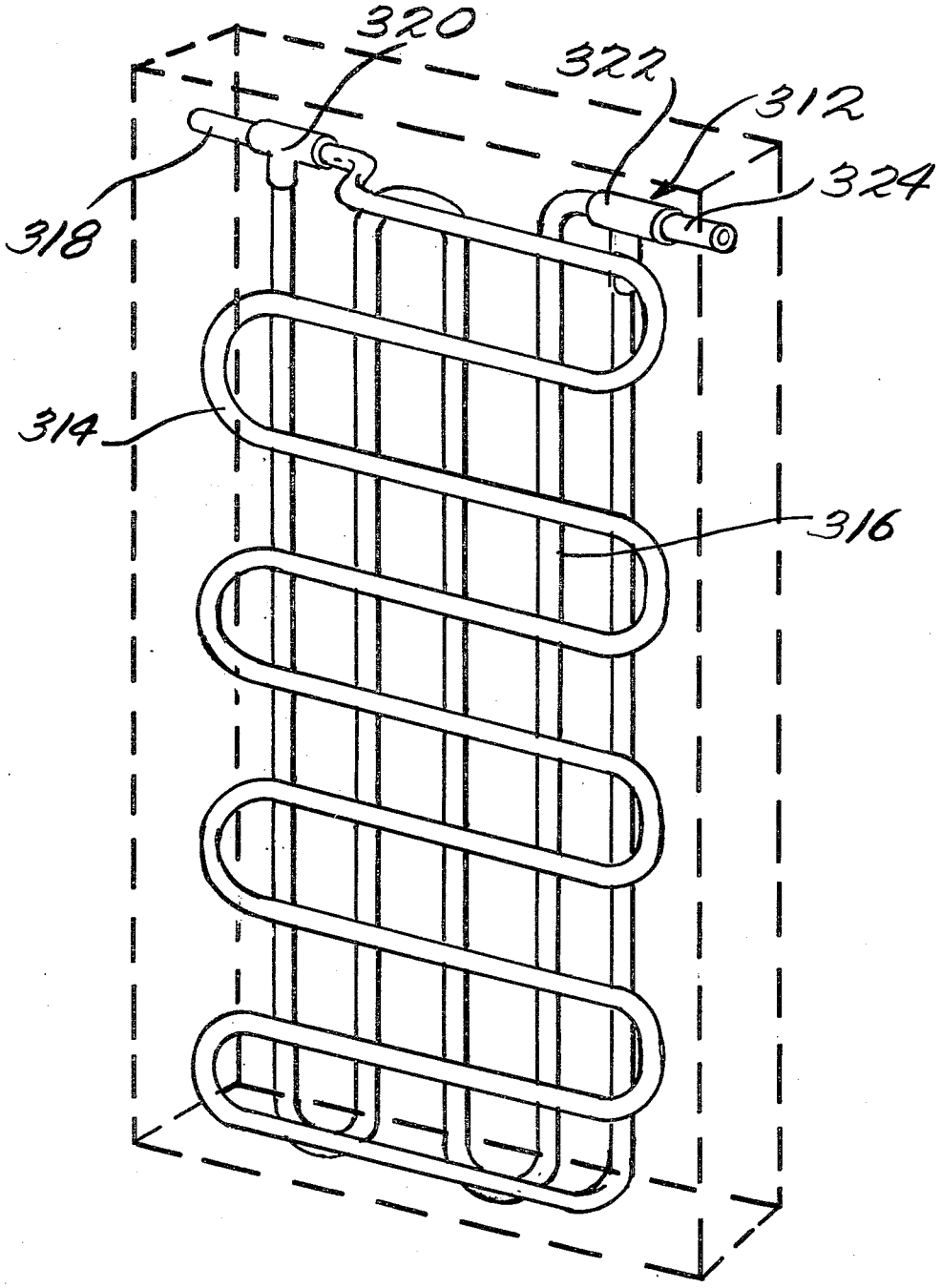
FIG. 18 is a perspective view of a modified form of reinforcing grid which may be utilized in the panels of the present invention.

Referring now more particularly to FIG. 18 there is shown therein a modified grid, generally indicated at 312. The grid is made up essentially of two continuous serpentine-shaped hollow rods 314 and 316. The two hollow rods are mounted in side-by-side abutting relation and are rigidly interconnected at their joints so as to exteriorly provide a grid similar to that previously provided capable of performing the reinforcing function within the panel. In addition, the interior hollow rods provide a flow space within which a fluid medium can be contained or passed. To this end, the grid includes an inlet pipe 318, one end of which extends in communicating relation to one side edge of the panel. The opposite end of the inlet pipe is connected, as by a T320, to one end of each of the serpentine hollow rods 314 and 316. In this regard, it will be noted that the hollow rod 314 which has straight portions parallel with the inlet pipe has the opposite end portion thereof extending at right angles so that it terminates at a position adjacent the end of the other serpentine hollow rod 316 at a position opposite from the inlet pipe 318. These adjacent ends are interconnected by T fitting 322 which, in turn, is connected with an outlet pipe 324. The grid 312 may be utilized in lieu of any one of the grids previously described. Where utilized in vertical panels it is preferably utilized in lieu of the innermost grid. In floor/ceiling panels two such grids may be utilized in lieu of the pair of grids utilized therein. The flow space provided by the grid is particularly suited as a substantially constant temperature storage space for fluid medium connected with solar collectors.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A pre-cast reinforced concrete building panel operable to form a section of an exterior vertical wall of a building, said panel in operative position comprising:

a pair of metal reinforcing rod grids of a width generally equal to the width of the panel extending vertically generally throughout the vertical extent of said panel rigidly interconnected along their upper and lower edges in horizontally spaced relation, a plurality of metal welding bars fixed rigidly to said grids extending vertically generally throughout the vertical extent of said panel, a plurality of socket defining metal tubular members fixed rigidly to said grids and extending vertically in vertically aligned horizontally spaced relation along the upper and lower edges of the panel, a block of rigid insulating material disposed between said grids generally throughout the width and vertical extent thereof, a body of concrete hardened in contact with said grids, said bars, said tubular members, and said block of insulating material so as to provide therewith (1) an upper horizontal edge configuration from which said socket defining tubular members extend vertically downwardly, (2) a lower horizontal edge configuration, (3) an exterior vertical face defining substantially the entire exterior wall configuration of the panel, (4) an interior vertical face defining substantially the entire interior wall configuration of the panel and (5) oppositely facing vertically extending side edge configurations defining the width of said panel in which said welding bars present a plurality of substantially continuous relatively narrow vertically extending welding surfaces each of which is recessed from and faces toward an adjacent vertical face, means defining an electrical junction box recessed within the interior vertical face of the concrete body, and means providing electric wire access through said panel to said electrical junction box defining means.

2. A building panel as defined in claim 1 wherein said block of rigid insulating material comprises foamed polyurethane covered exteriorly with a wrapping providing a vapor barrier.

3. A building panel as defined in claim 2 wherein said wrapping is a laminate of paper and metal foil.

4. A building panel as defined in claim 1 wherein said block of rigid insulating material extends from one side edge configuration to the other.

5. A building panel as defined in claim 1, 2, 3 or 4 wherein the grid adjacent said interior face includes hollow rods, defining a flow space for a fluid medium from solar energy collection means or the like, inlet means extending from the exterior of said panel to the flow space and outlet means communicating the flow space with the exterior of said panel so that a fluid medium may be passed through said inlet means, through said hollow rod flow space and then through said outlet means.

6. A building panel as defined in claim 1, 2, 3 or 4 wherein said welding bars are of generally elongated rectangular cross-sectional configuration, there being two such bars in each side edge configuration spaced apart and arranged with the elongated extent of their cross-sections in alignment.

7. A building panel as defined in claim 1, 2, 3 or 4 wherein the exterior vertical face has a textured surface cast therein.

8. A building panel as defined in claim 7 wherein said textured surface simulates brick.

9. A building panel as defined in claim 1, 2, 3 or 4 wherein said interior vertical face is smooth.

10. A building panel as defined in claim 1, 2, 3 or 4 wherein said electrical junction box comprises a box formed of five metal walls defining an open sixth wall aligned with said interior vertical face, said electric wire access providing means comprising a tubular member extending horizontally from one side edge configuration to one of the walls of said electrical junction box.

11. A building panel as defined in claim 10 wherein said electric wire access providing means further includes a pair of vertically extending tubes, one of which extends from a lower horizontal edge configuration of said panel to a lower wall of said electric box and the other of which extends from an upper wall of said electrical junction box to the upper horizontal edge configuration of the panel.

12. A building panel as defined in claim 1, 2, 3 or 4 wherein each of said tubular members has an interior periphery of a size to receive the end portion of a vertical downwardly extending connecting rod for grouting therein when in its operative position, the interior periphery of each of said tubular members having interior threads formed thereon for removably receiving therein a lifting assembly suitable to be engaged by a crane so that said panel can be lifted and lowered by the crane into its operative position.

13. A structure for receiving concrete in hardened relation therewith so as to provide a building panel operable to form a section of an exterior vertical wall of a building, said structure in operative position comprising a pair of metal reinforcing rod grids extending vertically generally throughout the vertical extent of said panel rigidly interconnected along their upper and lower edges in horizontally spaced relation, a block of rigid insulating material of a width equal to the width of the panel disposed between said grids generally throughout the vertical extent thereof and having opposite exterior side edges adjacent the side edges of said grids, and a pair of vertically extending welding bars disposed on opposite sides of each exterior side edge of said block of rigid insulating material, each of said welding bars being rigidly secured to the adjacent side edge of the associated grid.

14. A structure as defined in claim 13 wherein the pair of grids includes hollow rods, defining flow space for a fluid medium from solar energy collection means or the like, inlet means extending from the exterior of said panel to the flow space and outlet means communicating the flow space with the exterior of said panel so that a fluid medium may be passed through said inlet means, through said hollow rod flow space and then through said outlet means.

15. A structure as defined in claim 14 wherein said block of rigid insulating material comprises foamed polyurethane covered exteriorly with a wrapping providing a vapor barrier.

16. A structure as defined in claim 15 wherein said wrapping is a laminate of paper and metal foil.

17. A structure as defined in claim 13, 14 or 15 wherein said welding bars are of generally elongated rectangular cross-sectional configuration, there being two such bars in each side edge configuration spaced apart and arranged with the elongated extent of their cross-sections in alignment.

18. A structure as defined in claims 13 14, 15 or 16 including a plurality of socket defining metal tubular members fixed rigidly to said grids and extending vertically in horizontally spaced relation along the upper edges thereof, each of said tubular members having an interior periphery of a size to receive the end portion of a vertical downwardly extending connecting rod for grouting therein when in its operative position, the interior periphery of each of said tubular members having interior threads formed thereon for removably receiving therein a lifting assembly suitable to be engaged by a crane so that said panel can be lifted and lowered by the crane into its operative position.

19. A structure as defined in claim 18 wherein a plurality of vertically extending tubular members is mounted in horizontally spaced relation along the lower edge configuration of said panel so as to define a plurality of downwardly opening sockets therein.

20. A structure as defined in claim 19 wherein each of said tubular members is formed by wrapping a metal rod of circular cross-sectional configuration in a helical configuration with the volutes touching one another, said tubular member being secured to said grids by a plurality of L-shaped rods having one leg welded to the exterior periphery of said helical rod and the other leg welded to one of said grids.

* * * * *